US008038740B2

(12) United States Patent
Subkowski et al.

(10) Patent No.: US 8,038,740 B2
(45) Date of Patent: Oct. 18, 2011

(54) USE OF PROTEINS AS AN ANTIFOAMING CONSTITUENT IN FUELS

(75) Inventors: Thomas Subkowski, Ladenburg (DE); Hans-Georg Lemaire, Limburgerhof (DE); Marvin Karos, Schwetzingen (DE); Susan Hammer, Ludwigshafen (DE); Joern Karl, Ludwigshafen (DE); Dietmar Posselt, Heidelberg (DE)

(73) Assignee: BASF SE, Ludwigshafen (DE)

( * ) Notice: Subject to any disclaimer, the term of this patent is extended or adjusted under 35 U.S.C. 154(b) by 807 days.

(21) Appl. No.: 12/083,404

(22) PCT Filed: Oct. 9, 2006

(86) PCT No.: PCT/EP2006/067169

§ 371 (c)(1), (2), (4) Date: Apr. 10, 2008

(87) PCT Pub. No.: WO2007/042487

PCT Pub. Date: Apr. 19, 2007

(65) Prior Publication Data

US 2009/0241413 A1 Oct. 1, 2009

(30) Foreign Application Priority Data

Oct. 12, 2005 (DE) ..... 10 2005 048 720

(51) Int. Cl.
*C10L 1/10* (2006.01)

(52) U.S. Cl. ..... 44/300; 44/307; 44/405; 44/410; 44/628

(58) Field of Classification Search ..... 44/300, 44/628, 307, 405, 410
See application file for complete search history.

(56) References Cited

U.S. PATENT DOCUMENTS

| | | | |
|---|---|---|---|
| 2,399,161 | A | 4/1946 | Brother et al. |
| 3,751,280 | A | 8/1973 | Nerurkar et al. |
| 4,129,706 | A | 12/1978 | Keppler et al. |
| 4,241,191 | A | 12/1980 | Keppler et al. |
| 5,015,677 | A | 5/1991 | Benedict et al. |
| 5,049,504 | A | 9/1991 | Maugh et al. |
| 5,110,835 | A | 5/1992 | Walter et al. |
| 5,290,819 | A | 3/1994 | Witt et al. |
| 5,542,960 | A | 8/1996 | Grabowski et al. |
| 5,859,198 | A | 1/1999 | Haber et al. |

(Continued)

FOREIGN PATENT DOCUMENTS

CA 2 599 985 10/2006

(Continued)

OTHER PUBLICATIONS

Hektor, H.J. et al., "Hydrophobins: proteins with potential", Current Opinion in Biotechnology, vol. 16, No. 4, (2005). pp. 434-439, XP005006169.

(Continued)

*Primary Examiner* — Cephia D Toomer
(74) *Attorney, Agent, or Firm* — Connolly Bove Lodge & Hutz LLP

(57) ABSTRACT

The present invention relates to the use of at least one hydrophobin or of a derivative thereof as a defoamer in additive compositions or fuels, to a process for defoaming fuels, to an additive and fuel composition comprising at least one hydrophobin or derivative thereof and at least one further fuel additive, and to a process for preparing at least one fuel composition.

16 Claims, 1 Drawing Sheet

U.S. PATENT DOCUMENTS

Figure 1:
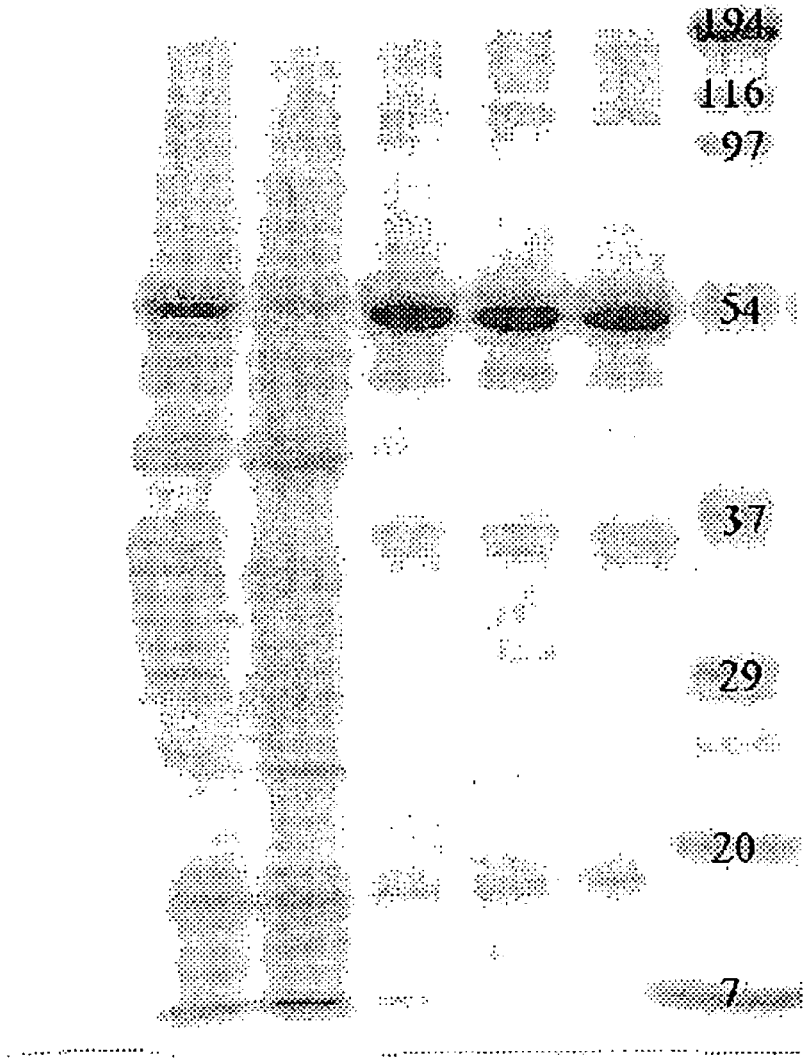

| | | | | |
|---|---|---|---|---|
| 6,977,239 | B1 | 12/2005 | Weuthen et al. | |
| 2003/0049726 | A1 | 3/2003 | Holloway et al. | |
| 2003/0113454 | A1 | 6/2003 | de Vocht et al. | |
| 2003/0134042 | A1 | 7/2003 | de Vocht et al. | |
| 2003/0217419 | A1* | 11/2003 | Vic | 8/406 |
| 2006/0040349 | A1 | 2/2006 | Sweigard et al. | |
| 2007/0077619 | A1 | 4/2007 | Ostermann et al. | |

FOREIGN PATENT DOCUMENTS

| | | | |
|---|---|---|---|
| DE | 2609104 | | 9/1977 |
| DE | 2638839 | | 3/1978 |
| DE | 4220225 | A1 | 12/1993 |
| DE | 19942539 | A1 | 3/2001 |
| DE | 10314853 | | 10/2004 |
| DE | 102004025805 | A1 | 12/2005 |
| EP | 0252516 | | 1/1988 |
| EP | 0252561 | | 1/1988 |
| EP | 0470455 | A2 | 2/1992 |
| EP | 0611824 | A1 | 8/1994 |
| EP | 0662515 | | 7/1995 |
| EP | 0773296 | | 5/1997 |
| EP | 1010748 | A1 | 6/2000 |
| EP | 1223219 | | 7/2002 |
| FR | 2833490 | A1 | 6/2003 |
| GB | 195876 | | 4/1923 |
| GB | 2173510 | | 10/1986 |
| GB | 2235457 | | 3/1991 |
| GB | 2248068 | | 3/1992 |
| JP | 60206893 | | 10/1985 |
| JP | 05132682 | | 5/1993 |
| JP | 06327481 | | 11/1994 |
| JP | 07289261 | | 11/1995 |
| JP | 08266281 | | 10/1996 |
| WO | WO-9409094 | A1 | 4/1994 |
| WO | WO-9641882 | A1 | 12/1996 |
| WO | WO-0023039 | A2 | 4/2000 |
| WO | WO-00/58342 | A1 | 10/2000 |
| WO | WO-0138476 | A1 | 5/2001 |
| WO | WO-01/57528 | A1 | 8/2001 |
| WO | WO-0157066 | A2 | 8/2001 |
| WO | WO-0160916 | A1 | 8/2001 |
| WO | WO-0174864 | | 10/2001 |
| WO | WO-0220651 | | 3/2002 |
| WO | WO-0246342 | A2 | 6/2002 |
| WO | WO-0246369 | | 6/2002 |
| WO | WO-03010331 | | 2/2003 |
| WO | WO-03018673 | A1 | 3/2003 |
| WO | WO-03031500 | A1 | 4/2003 |
| WO | WO-03053383 | A2 | 7/2003 |
| WO | WO-03080137 | A1 | 10/2003 |
| WO | WO-2004/000880 | A1 | 12/2003 |
| WO | WO-2004000880 | | 12/2003 |
| WO | WO-2005033316 | A2 | 4/2005 |
| WO | WO-2005068087 | A2 | 7/2005 |
| WO | WO-2005115306 | A2 | 12/2005 |
| WO | WO-2006082251 | A1 | 8/2006 |
| WO | WO-2006/103251 | A1 | 10/2006 |
| WO | WO-2006103215 | A1 | 10/2006 |
| WO | WO-2006103225 | A1 | 10/2006 |
| WO | WO-2006103230 | A1 | 10/2006 |
| WO | WO-2006103251 | | 10/2006 |
| WO | WO-2006103252 | A2 | 10/2006 |
| WO | WO-2006103253 | A2 | 10/2006 |
| WO | WO-2006131555 | A1 | 12/2006 |
| WO | WO-2006131564 | A2 | 12/2006 |
| WO | WO-2006136607 | A2 | 12/2006 |
| WO | WO-2007006765 | A1 | 1/2007 |
| WO | WO-2007014897 | A1 | 2/2007 |
| WO | WO-2007042487 | A2 | 4/2007 |

OTHER PUBLICATIONS

Stringer, M. A., et al., "dewA Encodes a Fungal Hydrophobin Component of the *Aspergillus* Spore Wall", Molecular Microbiology, 1995, vol. 16, No. 1, pp. 33-44.

Belitsky, B. R., "Physical and Enzymological Interaction of *Bacillus subtilis* Proteins Required for De Novo Pyridoxal 5' Phosphate Biosynthesis", Journal of Bacteriology, 2004, vol. 186, No. 4, pp. 1191-1196.

Wösten, H. A. B., "Hydrophobins: Multipurpose Proteins", Annu. Rev. Microbial., 2001, vol. 55, pp. 625-646.

Janssen, M.I., et al., Coating with Genetic Engineered Hydrophobin Promotes Growth of Fibroblasts on a Hydrophobic Solid, Biomaterials, 2002, vol. 23, pp. 4847-4854.

Ananichev, A.V., et al., "Immobilization of Glucose Isomerase by Adsorption on Porous Silochrome Under Vacuum", Prikladnaya Biokhimiya I Mikrobiologiya, 1984, vol. 20, No. 4, pp. 458-463.

Corvis, Y., et al., "Preparing catalytic surfaces for sensing applications by immobilizing enzymes via hydrophobin layers", Anal. Chem., 2005, vol. 77, pp. 1622-1630.

Scholtmeijer, K., et al., "Surface modifications created by using engineered hydrophobins", Applied and Environmental Microbiology, 2002, vol. 68, No. 3, pp. 1367-1373.

Scholtmeijer, K., et al., "Fungal hydrophobins in medical and technical applications", Applied Microbiology & Biotechnology, 2001, vol. 56, pp. 1-8.

De Vocht, M. L., et al., "Structural and functional role of the disulfide bridges in the hydrophobin SC3", Journal of Biological Chemistry, 2000, vol. 275, No. 37, pp. 28428-28432.

Hider, G.C., "A relatively simple test for the direct determination of the cysteine content in photographic gelatin using a thiol-specific fluorogenic reagent", The Imaging Science Journal, 1997, vol. 45, pp. 162-166.

Bauer, J. A., et al., "Three-dimensional structure of YaaE from *Bacillus subtilis*, a glutaminase implicated in pyridoxal-5'-phosphate biosynthesis", Journal of Biological Chemistry, 2004, vol. 279, No. 4, pp. 2704-2711.

Imai, Y., et al., "The Fission Yeast Mating Pheromone P-factor: its Molecular Structure, Gene Structure, and Ability to Induce Gene Expression and $G_1$ Arrest in the Mating Partner", Development, 1994, vol. 8, pp. 328-338.

Nakari-Setala, T., et al., "Expression of a Fungal Hydrophobin in the *Saccharomyces cerevisiae* Cell Wall: Effect on Cell Surface Properties and Immobilization", Applied and Environmental Microbiology, 2002, vol. 68, No. 7, pp. 3385-3391.

Linder, M., et al., "Surface Adhesion of Fusion Proteins Containing the Hydrophobins HFBI and HFBII from *Trichoderma reesei*", Protein Science, 2002, vol. 11, pp. 2257-2266.

* cited by examiner

Lane A B C D E F

USE OF PROTEINS AS AN ANTIFOAMING CONSTITUENT IN FUELS

RELATED APPLICATIONS

This application is a national stage application under 35 U.S.C. 371 of PCT/EP2006/067169, filed Oct. 9, 2006, which is incorporated by reference in its entirety and claims benefit of German application 10 2005 048 720.3, filed Oct. 12, 2005, which is incorporated by reference in its entirety.

The present invention relates to the use of at least one hydrophobin or of a derivative thereof as a defoamer in additive compositions or fuels, to a process for defoaming fuels, to additive and fuel compositions comprising at least one hydrophobin or derivative thereof and at least one further fuel additive, and also to a process for producing at least one fuel composition.

The hydrocarbon mixtures used as fuel, which may also include aromatics, gas oil and kerosene, have the unpleasant property of developing foam in conjunction with air when they are transferred into stock vessels such as storage tanks and fuel tanks of motor vehicles. This leads to retardation of the transfer operation and to unsatisfactory filling of the vessels. It is therefore customary to add defoamers to the diesel fuel. These defoamers should be active in minimum concentration and must not form any damaging residues in the course of combustion of the diesel fuel in the engine or adversely affect the combustion of the fuel. Correspondingly active defoamers are described in the patent literature.

For instance, antifoams and defoamers based on silicon are known. DE 103 13 853 A discloses, for example, organofunctionally modified polysiloxanes and their use for defoaming liquid fuel, especially diesel fuel.

GB-B 2 173 510 relates to a process for defoaming diesel fuel or jet fuel, in which an antifoam based on a silicon polyether copolymer is added to the fuel.

One disadvantage of known antifoams is the poor defoaming of moist diesel fuel. Moist diesel fuel is understood to mean a fuel which includes approx. 250 ppm of water. This water is either water of condensation which gets into the fuel in the storage tanks or is introduced into the fuel during transport in oil tankers, as a result of the incomplete emptying of the tank of water.

It is also known from U.S. Pat. No. 5,542,960 that phenol derivatives (more preferably eugenol) exhibit a relatively good defoaming capacity in moist diesel fuel.

The antifoams described and further antifoams known from the prior art for diesel fuels feature various disadvantages. For instance, the silicon content of typical polysiloxane-polyoxyalkylene copolymers is from 10 to 15% by weight or even from 20 to 25% by weight. Since compounds with such a high silicon content can lead to undesired silicon dioxide deposits in the engine in the course of combustion, there is a desire for defoamers for diesel fuels with reduced silicon fraction or at least improved foam prevention and foam elimination, in order to be able to reduce the use concentration of these additives.

A further disadvantage of the known antifoams is that their compatibility (miscibility) with the additive packages which are added to the raw diesel oil to improve its properties is often too low. Additive packages are understood to mean mixtures of different additives, for example agents for improving the combustion performance, agents for reducing smoke formation, agents for reducing the formation of harmful exhaust gases, inhibitors for reducing the corrosion in the engine and its parts, interface-active substances, lubricants and the like. Such additive packages are described, for example, in JP-05 132 682, GB-2 248 068 and in the journal Mineralöltechnik, 37(4), 20. The additives of the additive package are dissolved in an organic solvent to give a stock concentrate which is added to the raw diesel fuel. Antifoams with polar groups frequently cannot be incorporated uniformly into these additive packages or separate in the course of storage.

One possible approach is that of naturally occurring additives which have the desired properties. A suitable variety of substances is present, for example, in the case of proteins.

Proteins are macromolecules which are formed from amino acids. The length of these polypeptide chains ranges from below 50, for example 10, up to over 1000 amino acids.

For the mode of action of the proteins, their three-dimensional structure is particularly important. The protein structure can be described by the primary structure, the secondary structure, the tertiary structure and the quaternary structure. The primary structure refers to the sequence of the individual amino acids within the polypeptide chain. The three-dimensional arrangement of the amino acids of a protein is referred to as the secondary structure. The tertiary structure is a three-dimensional arrangement of the polypeptide chain superordinate the secondary structure. It is determined by the forces and bonds between the residues (i.e. the side chains) of the amino acids. If a plurality of molecules in a three-dimensional arrangement form a superordinate functional unit, this is referred to as quaternary structure.

A distinction is drawn between two main groups of proteins, the globular proteins whose tertiary or quaternary structure has an approximately spherical or pear-shaped appearance and which are usually readily soluble in water or salt solutions, and the fibrillar proteins which have a thread-like or fibrous structure are usually insoluble and belong to the support and framework substances.

Hydrophobins are small proteins of from about 100 to 150 amino acids and are characteristic of filamentous fungi, for example *Schizophyllum commune*. They generally have 8 cysteine units.

Hydrophobins have a marked affinity for interfaces and are therefore suitable for coating surfaces in order to alter the properties of the interfaces by forming amphipathic membranes. For example, Teflon can be coated by means of hydrophobins to obtain a hydrophilic surface.

Hydrophobins can be isolated from natural sources. Likewise known are preparation methods for hydrophobins and derivatives thereof. For example, DE 10 2005 007 480.4 discloses a preparation process for hydrophobins and derivatives thereof.

Owing to the exceptional properties of hydrophobins for the coating of surfaces, these proteins have a high potential for numerous industrial applications. The prior art proposes the use of hydrophobins for various applications.

WO 96/41882 proposes the use of hydrophobins as emulsifiers, thickeners, surface-active substances, for the hydrophilization of hydrophobic surfaces, for the improvement of the water resistance of hydrophilic substrates, for the preparation of oil-in-water emulsions or of water-in-oil emulsions. Also proposed are pharmaceutical applications such as the production of ointments or creams, and also cosmetic applications such as skin protection or the production of hair shampoos or hair rinses. WO 96/41882 additionally claims compositions, especially compositions for pharmaceutical applications, comprising hydrophobins.

EP-A 1 252 516 discloses the coating of windows, contact lenses, biosensors, medical devices, vessels for carrying out experiments or for storage, ships' hulls, solid particles or frames or chassis of passenger vehicles with a solution comprising hydrophobins at a temperature of from 30 to 80° C.

WO 03/53383 discloses the use of hydrophobin for treating keratin materials in cosmetic applications.

WO 03/10331 discloses that hydrophobins have surface-active properties. For instance, a hydrophobin-coated sensor is disclosed, for example a test electrode, to which further substances, for example electroactive substances, antibodies or enzymes, are bonded in a noncovalent manner.

WO 2004/000880 likewise discloses the coating of surfaces with hydrophobin or hydrophobin-like substances. It is also disclosed that oil-in-water or water-in-oil emulsions can also be stabilized by adding hydrophobins.

WO 01/74864, which relates to hydrophobin-like proteins, also discloses that they can be used to stabilize dispersions and emulsions.

EP 05 007 208.1 proposes the use of proteins, especially of hydrophobins or derivates thereof, as demulsifiers.

Proceeding from the prior art, it was an object of the present invention to provide defoamers which have good defoaming action and have a low Si content.

It was a further object of the present invention to provide defoamers which, in addition to good defoaming action, are inexpensive.

It was a further object of the present invention to provide defoamers which, in addition to good defoaming action, are inexpensive and environmentally compatible.

According to the invention, this object is achieved by the use of at least one hydrophobin or of a derivative thereof as a defoamer in additive compositions or fuels.

The use of hydrophobins or derivatives thereof has the advantage that they are also naturally occurring substances which are biodegradable and thus do not lead to pollution of the environment. Moreover, the degradation forms hardly any substances which lead to deposits in the engine area.

According to the invention, hydrophobins or derivatives thereof are used as defoamers, i.e. the foam formation of a fuel or of a fuel composition is reduced.

According to the invention, it is possible to add at least one hydrophobin or a derivative thereof alone to a fuel as a defoamer. However, it is equally possible to use at least one hydrophobin or derivative thereof in combination with at least one further compound which acts as a defoamer. It is equally possible to use different hydrophobins or derivatives thereof in combination.

In the context of the present invention, a hydrophobin or a derivative thereof is understood to mean a hydrophobin or a modified hydrophobin. The modified hydrophobin may, for example, be a hydrophobin fusion protein or a protein which has a polypeptide sequence which has at least 60%, for example at least 70%, in particular at least 80%, more preferably at least 90%, especially preferably at least 95% identity with the polypeptide sequence of a hydrophobin, and which also satisfies the biological properties of a hydrophobin to an extent of 50%, for example to an extent of 60%, in particular to an extent of 70%, more preferably to an extent of 80%, especially the property that the surface properties are altered by coating with these proteins such that the contact angle of a water droplet before and after the coating of a glass surface with the protein is increased by at least 20°, preferably by at least 25°, in particular by at least 30°.

It has been found that, surprisingly, hydrophobins or derivatives thereof deliver good results in the case of use as defoamers.

For the definition of hydrophobins, what is crucial is the structural specificity and not the sequence specificity of the hydrophobins. The amino acid sequence of the mature hydrophobins is very diverse, but they all have a highly characteristic pattern of 8 conserved cysteine residues. These residues form four intramolecular disulfide bridges.

The N terminus and C terminus are variable over a relatively wide range. It is possible here to add on fusion partner proteins having a length of from 10 to 500 amino acids by means of molecular biology techniques known to those skilled in the art.

Moreover, hydrophobins and derivatives thereof are also understood in the context of the present invention to mean proteins with a similar structure and functional equivalence.

In the context of the present invention, the term "hydrophobins" should be understood hereinafter to mean polypeptides of the general structural formula (I)

$$X_n—C^1—X_{1-50}—C^2—X_{0-5}—C^3—X_{1-100}—C^4—X_{1-100}—C^5—X_{1-50}—C^6—X_{0-5}—C^7—X_{1-50}—C^8—X_m \quad (I)$$

where X may be any of the 20 naturally occurring amino acids (Phe, Leu, Ser, Tyr, Cys, Trp, Pro, His, Gln, Arg, Ile Met, Thr, Asn, Lys, Val, Ala, Asp, Glu, Gly). In the formula, X may be the same or different in each case. The indices beside X are each the number of amino acids, C is cysteine, alanine, serine, glycine, methionine or threonine, where at least four of the residues designated with C are cysteine, and the indices n and m are each independently natural numbers between 0 and 500, preferably between 15 and 300.

The polypeptides of the formula (I) are also characterized by the property that, at room temperature, after coating a glass surface, they bring about an increase in the contact angle of a water droplet of at least 20°, preferably at least 25° and more preferably 30°, compared in each case with the contact angle of an equally large water droplet with the uncoated glass surface.

The amino acids designated with $C^1$ to $C^8$ are preferably cysteines; however, they may also be replaced by other amino acids with similar space-filling, preferably by alanine, serine, threonine, methionine or glycine. However, at least four, preferably at least 5, more preferably at least 6 and in particular at least 7 of positions $C^1$ to $C^8$ should consist of cysteines. In the inventive proteins, cysteines may either be present in reduced form or form disulfide bridges with one another. Particular preference is given to the intramolecular formation of C—C bridges, especially that with at least one intramolecular disulfide bridge, preferably 2, more preferably 3 and most preferably 4 intramolecular disulfide bridges. In the case of the above-described exchange of cysteines for amino acids with similar space-filling, such C positions are advantageously exchanged in pairs which can form intramolecular disulfide bridges with one another.

If cysteines, serines, alanines, glycines, methionines or threonines are also used in the positions designated with X, the numbering of the individual C positions in the general formulae can change correspondingly.

Preference is given to using hydrophobins of the general formula (II)

$$X_n—C^1—X_{3-25}—C^2—X_{0-2}—C^3—X_{5-50}—C^4—X_{2-35}—C^5—X_{2-15}—C^6—X_{0-2}—C^7—X_{3-35}—C^8—X_m \quad (II)$$

to perform the present invention, where X, C and the indices beside X and C are each as defined above, the indices n and m are each numbers between 0 and 300, and the proteins additionally feature the above-illustrated change in contact angle, and at least 6 of the residues designated with C are cysteine. More preferably, all C residues are cysteine.

Particular preference is given to using hydrophobins of the general formula (III)

$$X_n—C^1—X_{5-9}—C^2—C^3—X_{11-39}—C^4—X_{2-23}—C^5—X_{5-9}—C^6—C^7—X_{6-18}—C^8—X_m \quad (III)$$

where X, C and the indices besides X are each as defined above, the indices n and m are each numbers between 0 and 200, and the proteins additionally feature the above-illustrated change in contact angle.

The $X_n$ and $X_m$ residues may be peptide sequences which naturally are also joined to a hydrophobin. However, one or both residues may also be peptide sequences which are naturally not joined to a hydrophobin. This is also understood to mean those $X_n$ and/or $X_m$ residues in which a peptide sequence which occurs naturally in a hydrophobin is lengthened by a peptide sequence which does not occur naturally in a hydrophobin.

If $X_n$ and/or $X_m$ are peptide sequences which are not naturally bonded into hydrophobins, such sequences are generally at least 20, preferably at least 35, more preferably at least 50 and most preferably at least 100 amino acids in length. Such a residue which is not joined naturally to a hydrophobin will also be referred to hereinafter as a fusion partner. This is intended to express that the proteins may consist of at least one hydrophobin moiety and a fusion partner moiety which do not occur together in this form in nature.

The fusion partner moiety may be selected from a multitude of proteins. It is also possible for a plurality of fusion partners to be joined to one hydrophobin moiety, for example on the amino terminus ($X_n$) and on the carboxyl terminus ($X_m$) of the hydrophobin moiety. However, it is also possible, for example, for two fusion partners to be joined to one position ($X_n$ or $X_m$) of the inventive protein.

Particularly suitable fusion partners are proteins which naturally occur in microorganisms, especially in *E. coli* or *Bacillus subtilis*. Examples of such fusion partners are the sequences yaad (SEQ ID NO: 15 and 16), yaae (SEQ ID NO: 17 and 18), and thioredoxin. Also very suitable are fragments or derivatives of these sequences which comprise only some, preferably from 70 to 99%, more preferably from 80 to 98% of the sequences mentioned, or in which individual amino acids or nucleotides have been changed compared to the sequence mentioned, in which case the percentages are each based on the number of amino acids.

The proteins used in accordance with the invention as hydrophobins or derivatives thereof may also be modified in their polypeptide sequence, for example by glycosilization, acetylation or else by chemical crosslinking, for example with glutaraldehyde.

One property of the hydrophobins or derivatives thereof used in accordance with the invention is the change in surface properties when the surfaces are coated with the proteins. The change in the surface properties can be determined experimentally, for example, by measuring the contact angle of a water droplet before and after the coating of the surface with the protein and determining the difference of the two measurements.

The performance of contact angle measurements is known in principle to those skilled in the art. The measurements are based on room temperature and water droplets of 5 μl. The precise experimental conditions for an example of a suitable method for measuring the contact angle are given in the experimental section. Under the conditions mentioned there, the proteins used in accordance with the invention have the property of increasing the contact angle by at least 20°, preferably at least 25°, more preferably at least 30°, compared in each case with the contact angle of an equally large water drop with the uncoated glass surface.

In the hydrophobin moiety of the hydrophobins or derivatives thereof known to date, the positions of the polar and nonpolar amino acids are conserved, which is manifested in a characteristic hydrophobicity plot. Differences in the biophysical properties and the hydrophobicity led to the division of the hydrophobins known to date into two classes, I and II (Wessels et al. 1994, Ann. Rev. Phytopathol., 32, 413-437).

The assembled membranes composed of class I hydrophobins are highly insoluble (even toward 1% sodium dodecylsulfate (SDS) at elevated temperature) and can only be dissociated again by concentrated trifluoroacetic acid (TFA) or formic acid. In contrast, the assembled forms of class II hydrophobins are less stable. They can be dissolved again merely by 60% ethanol or 1% SDS (at room temperature).

A comparison of the amino acid sequences shows that the length of the region between cysteine $C^3$ and $C^4$ in class II hydrophobins is distinctly shorter than in class I hydrophobins. Class II hydrophobins also have more charged amino acids than class I.

Particularly preferred hydrophobins for performing the present invention are the hydrophobins of the dewA, rodA, hypA, hypB, sc3, basf1, basf2 type, which are characterized structurally in the sequence listing which follows. They may also only be parts or derivatives thereof. It is also possible for a plurality of hydrophobin moieties, preferably 2 or 3, of the same or different structure to be bonded to one another and be bonded to a corresponding suitable polypeptide sequence which is naturally not joined to a hydrophobin.

Particularly suitable in accordance with the invention are also the fusion proteins with the polypeptide sequences shown in SEQ ID NO: 20, 22, 24, and also the nucleic acid sequences encoding them, especially the sequences according to SEQ ID NO: 19, 21, 23. Particularly preferred embodiments are also proteins which derive from the polypeptide sequences shown in SEQ ID NO. 20, 22 or 24 by virtue of exchange, insertion or deletion of at least one, up to 10, preferably 5, more preferably 5% of all amino acids, and which still have the biological property of the starting proteins to an extent of at least 50%. In this context, biological property of the proteins refers to the change in the contact angle by at least 20° already described.

Suitable fusion partners are proteins which lead to the fusion protein thus generated being capable of coating surfaces and simultaneously resistant toward a detergent treatment. Examples of fusion partners are, for example, yaad and yaae in *E. coli*, and thioredoxin.

It has been found that the fusion proteins produced in this way are functionally already active, and the hydrophobins do not, as described in the literature, have to be dissociated and thus activated by trifluoroacetic acid or formic acid treatment. Solutions which comprise these fusion proteins or, after cleavage of the fusion protein, comprise only the hydrophobin are suitable directly for the coating of surfaces.

At C- or N-terminal fusion with an affinity tag (for example $His_6$, HA, calmodulin-BD, GST, MBD, chitin-BD, streptavidin-BD-Avi Tag, Flag-Tag, T7, etc.) is found to be favorable for rapid and efficient purification. Corresponding standard protocols can be obtained from the commercial suppliers of the affinity tags.

A cleavage site between the hydrophobin and the fusion partner or the fusion partners can be utilized to release the pure hydrophobin in underivatized form (for example by BrCN cleavage at methionin, factor Xa cleavage, enterokinase cleavage, thrombin cleavage, TEV cleavage, etc.).

It is also possible to generate fusion proteins in succession from one fusion partner, for example yaad or yaae, and a plurality of hydrophobins, even of different sequence, for example DewA-RodA or Sc3-DewA, Sc3-RodA. It is equally possible to use hydrophobin fragments (for example N- or C-terminal truncations) or mutein which have up to 70% homology. The optimal constructs are in each case selected in relation to the particular use, i.e. the fuel to be defoamed.

The polypeptides used in accordance with the invention or present in the inventive compositions can be prepared chemically by known methods of peptide synthesis, for example by Merrifield solid-phase synthesis.

Naturally occurring hydrophobins can be isolated from natural sources by means of suitable methods. Reference is made by way of example to Wösten et. al., Eur. J. Cell Bio. 63, 122-129 (1994) or WO 96/41882.

Fusion proteins can be prepared preferably by genetic engineering methods, in which one nucleic acid sequence, especially DNA sequence, encoding the fusion partner and one encoding the hydrophobin moiety are combined in such a way that the desired protein is generated in a host organism as a result of gene expression of the combined nucleic acid sequence. Such a preparation process is disclosed, for example, in DE 102005007480.4.

Suitable host organisms (production organisms) for the preparation method mentioned may be prokaryotes (including the Archaea) or eukaryotes, particularly bacteria including halobacteria and methanococcia, fungi, insect cells, plant cells and mammalian cells, more preferably *Escherichia coli, Bacillus subtilis, Bacillus megaterium, Aspergillus oryzae, Aspergillus nidulans, Aspergillus niger, Pichia pastoris, Pseudomonas* spec., *lactobacilli, Hansenula polymorpha, Trichoderma reesei*, SF9 (or related cells), among others.

In this method, expression constructs comprising a nucleic acid sequence which encodes a polypeptide used in accordance with the invention, under the genetic control of regulatory nucleic acid sequences, and also vectors comprising at least one of these expression constructs, are used.

Constructs which are used preferably comprise a promoter 5' upstream of the particular coding sequence and a terminator sequence 3' downstream, and also, if appropriate, further customary regulatory elements, each linked operatively to the coding sequence.

In the context of the present invention, an "operative linkage" is understood to mean the sequential arrangement of promoter, coding sequence, terminator and, if appropriate, further regulatory elements, such that each of the regulatory elements can fulfill its function as intended in the expression of the coding sequence.

Examples of operatively linkable sequences are targeting sequences, and also enhancers, polyadenylation signals and the like. Further regulatory elements comprise selectable markers, amplification signals, replication origins and the like. Suitable regulatory sequences are, for example, described in Goeddel, Gene Expression Technology: Methods in Enzymology 185, Academic Press, San Diego, Calif. (1990).

In addition to these regulation sequences, the natural regulation of these sequences may still be present upstream of the actual structural genes and, if appropriate, have been genetically modified so as to switch off the natural regulation and increase the expression of the genes.

A preferred nucleic acid construct also advantageously comprises one or more so-called "enhancer" sequences, joined functionally to the promoter, which enable increased expression of the nucleic acid sequence. Also at the 3' end of the DNA sequences, it is possible for additional advantageous sequences to be inserted, such as further regulatory elements or terminators.

The nucleic acids may be present in the construct in one or more copies. It is also possible for further markers such as antibiotic resistances or genes which complement auxotrophies to be present in the construct, if appropriate for selection for the construct.

Advantageous regulation sequences for the preparation are present, for example, in promoters such as the cos, tac, trp, tet, trp-tet, lpp, lac, lpp-lac, laclq-T7, T5, T3, gal-, trc, ara, rhaP (rhaPBAD) SP6, lambda-PR or imlambda-P promoter, which advantageously find use in Gram-negative bacteria. Further advantageous regulation sequences are present, for example, in the Gram-positive promoters amy and SP02, and in the yeast or fungal promoters ADC1, MFalpha, AC, P-60, CYC1, GAPDH, TEF, rp28, ADH.

It is also possible to use synthetic promoters for the regulation.

For expression in a host organism, the nucleic acid construct is advantageously inserted into a vector, for example a plasmid or a phage which enables optimal expression of the genes in the host. Apart from plasmids and phages, vectors are also understood to mean all other vectors known to those skilled in the art, for example viruses such as SV40, CMV, baculovirus and adenovirus, transposons, IS elements, phasmids, cosmids, and linear or circular DNA, and also the *Agrobacterium* system.

These vectors can be replicated autonomously in the host organism or replicated chromosomally. Suitable plasmids are, for example, in *E. coli* pLG338, pACYC184, pBR322, pUC18, pUC19, pKC30, pRep4, pHS1, pKK223-3, pDHE19.2, pHS2, pPLc236, pMBL24, pLG200, pUR290, pIN-III"3-B1, tgt11 or pBdCl, in *Streptomyces* pIJ101, pIJ364, pIJ702 or pIJ361, in *Bacillus* pUB110, pC194 or pBD214, in Corynebacterium pSA77 or pAJ667, in fungi pALS1, pIL2 or pBB116, in yeasts 2alpha, pAG-1, YEp6, YEp13 or pEMBLYe23 or in plants pLGV23, pGHlac+ pBIN19, pAK2004 or pDH51. The plasmids mentioned constitute a small selection of the possible plasmids. Further plasmids are known to those skilled in the art and can be taken, for example, from the book Cloning Vectors (Eds. Pouwels P. H. et al. Elsevier, Amsterdam-New York-Oxford, 1985, ISBN 0 444 904018).

Advantageously, the nucleic acid construct, for the expression of the further genes present, additionally also comprises 3'- and/or 5'-terminal regulatory sequences for enhancing the expression, which are selected for optimal expression depending upon the host organism and gene or genes selected.

These regulatory sequences are intended to enable the controlled expression of the genes and of the protein expression. Depending on the host organism, this can mean, for example, that the gene is expressed or overexpressed only after induction, or that it is expressed and/or overexpressed immediately.

The regulatory sequences or factors can preferably positively influence and thus increase the gene expression of the genes introduced. Thus, an amplification of the regulatory elements can advantageously be effected at the transcription level by using strong transcription signals such as promoters and/or enhancers. In addition, it is also possible to enhance the translation by, for example, improving the stability of the mRNA.

In a further embodiment of the vector, the vector comprising the nucleic acid construct or the nucleic acid can also be introduced into the microorganisms advantageously in the form of a linear DNA and be integrated into the genome of the host organism by means of heterologous or homologous recombination. This linear DNA can consist of a linearized vector such as a plasmid or only of the nucleic acid construct or the nucleic acid.

For an optimal expression of heterologous genes in organisms, it is advantageous to alter the nucleic acid sequences in accordance with the specific "codon usage" used in the organism. The "codon usage" can be determined easily with reference to computer evaluations of other, known genes of the organism in question.

An expression cassette is prepared by fusion of a suitable promoter with a suitable coding nucleotide sequence and a terminator signal or polyadenylation signal. To this end, common recombination and cloning techniques are used, as described, for example, in T. Maniatis, E. F. Fritsch and J. Sambrook, Molecular Cloning: A Laboratory Manual, Cold Spring Harbor Laboratory, Cold Spring Harbor, N.Y. (1989) and in T. J. Silhavy, M. L. Berman and L. W. Enquist, Experiments with Gene Fusions, Cold Spring Harbor Laboratory, Cold Spring Harbor, N.Y. (1984) and in Ausubel, F. M. et al., Current Protocols in Molecular Biology, Greene Publishing Assoc. and Wiley Interscience (1987).

For expression in a suitable host organism, the recombinant nucleic acid construct or gene construct is advantageously inserted into a host-specific vector which enables an optimal expression of the genes in the host. Vectors are well known to those skilled in the art and can be taken, for example, from "Cloning Vectors" (Pouwels P. H. et al., eds., Elsevier, Amsterdam-New York-Oxford, 1985).

With the aid of vectors, it is possible to prepare recombinant microorganisms which have been transformed, for example, with at least one vector and can be used for the production of the hydrophobins or derivatives thereof used in accordance with the invention. Advantageously, the above-described recombinant constructs are introduced into a suitable host system and expressed. Preference is given to using the cloning and transfection methods familiar to those skilled in the art, for example coprecipitation, protoplast fusion, electroporation, retroviral transfection and the like, in order to bring about the expression of the nucleic acids mentioned in the particular expression system. Suitable systems are described, for example, in Current Protocols in Molecular Biology, F. Ausubel et al., ed., Wiley Interscience, New York 1997, or Sambrook et al. Molecular Cloning: A Laboratory Manual, 2nd edition, Cold Spring Harbor Laboratory, Cold Spring Harbor Laboratory Press, Cold Spring Harbor, N.Y., 1989.

It is also possible to prepare homologously recombined microorganisms. To this end, a vector is prepared which comprises at least a section of a gene to be used or a coding sequence, in which, if appropriate, at least one amino acid deletion, additional or substitution has been introduced in order to change, for example to functionally disrupt, the sequence ("knockout" vector). The sequence introduced may, for example, also be a homolog from a related microorganism or be derived from a mammalian, yeast or insect source. The vector used for the homologous recombination may alternatively be configured such that the endogenous gene in the case of homologous recombination has been mutated or altered in another way, but still encodes the functional protein (for example, the upstream regulatory region can be changed such that the expression of the endogenous protein is changed). The changed section of the gene used in accordance with the invention is in the homologous recombination vector. The construction of suitable vectors for homologous recombination is described, for example, in Thomas, K. R. and Capecchi, M. R. (1987) Cell 51:503.

In principle, all prokaryotic or eukaryotic organisms are useful as recombinant host or ganisms for such nucleic acids or such nucleic acid constructs. Advantageously, the host organisms used are microorganisms such as bacteria, fungi or yeasts. Advantageously, Gram-positive or Gram-negative bacteria are used, preferably bacteria from the families Enterobacteriaceae, Pseudomonadaceae, Rhizobiaceae, Streptomycetaceae or Nocardiaceae, more preferably bacteria of the genera *Escherichia, Pseudomonas, Streptomyces, Nocardia, Burkholderia, Salmonella, Agrobacterium* or *Rhodococcus.*

The organisms used in the above-described preparation processes for fusion proteins are, depending on the host organism, grown or cultured in a manner known to those skilled in the art. Microorganisms are generally grown in a liquid medium which comprises a carbon source, usually in the form of sugars, a nitrogen source, usually in the form of organic nitrogen sources such as yeast extract or salts such as ammonium sulfate, trace elements such as iron, manganese and magnesium salts, and also, if appropriate, vitamins, at temperatures between 0 and 100° C., preferably between 10 to 60° C., with oxygen sparging. The pH of the nutrient liquid can be kept at a fixed value, i.e. is regulated or not during the growth. The growth can be effected batchwise, semi-batchwise or continuously. Nutrients can be introduced at the start of the fermentation or be replenished semicontinuously or continuously. The enzymes can be isolated from the organisms by the process described in the examples or be used for the reaction as a crude extract.

The proteins used in accordance with the invention, or functional, biologically active fragments thereof, can be prepared by means of a process for recombinant preparation, in which a polypeptide-producing microorganism is cultivated, the expression of the proteins is induced if appropriate and they are isolated from the culture. The proteins can also be produced in this way on an industrial scale if this is desired. The recombinant microorganism can be cultivated and fermented by known processes. Bacteria can be propagated, for example, in TB or LB medium and at a temperature of from 20 to 40° C. and a pH of from 6 to 9. Suitable cultivation conditions are described specifically in T. Maniatis, E. F. Fritsch and J. Sambrook, Molecular Cloning: A Laboratory Manual, Cold Spring Harbor Laboratory, Cold Spring Harbor, N.Y. (1989).

If the proteins are not secreted into the culture medium, the cells are then disrupted and the product is obtained from the lysate by known protein isolation processes. As desired, the cells can be disrupted by high-frequency ultrasound, by high pressure, for example in a French pressure cell, by osmolysis, by the action of detergents, lytic enzymes or organic solvents, by homogenizers or by combination of a plurality of the processes listed.

The proteins can be purified by known chromatographic processes, such as molecular sieve chromatography (gel filtration) such as Q Sepharose chromatography, ion exchange chromatography and hydrophobic chromatography, and also with other customary processes such as ultrafiltration, crystallization, salting-out, dialysis and native gel electrophoresis. Suitable processes are described, for example, in Cooper, F. G., Biochemische Arbeitsmethoden [Biochemical Techniques], Verlag Walter de Gruyter, Berlin, New York, or in Scopes, R., Protein Purification, Springer Verlag, New York, Heidelberg, Berlin.

It may be advantageous to isolate the recombinant protein by using vector systems or oligonucleotides which extend the cDNA by certain nucleotide sequences and hence encode altered polypeptides or fusion proteins which serve, for example, for simpler purification. Such suitable modifications comprise so-called "tags" which function as anchors, for example the modification known as the hexa-histidine anchor, or epitopes which can be recognized as antigens of antibodies (described, for example, in Harlow, E. and Lane, D., 1988, Antibodies: A Laboratory Manual, Cold Spring Harbor (N.Y.) Press). Further suitable tags are, for example, HA, calmodulin-BD, GST, MBD; Chitin-BD, streptavidin-BD-Avi Tag, Flag-Tag, T7 etc. These anchors may serve, for example, to attach the proteins to a solid support, for example a polymer matrix, which can be introduced, for example, into a chromatography column, or be used on a microtiter plate or on another support. The corresponding purification protocols are obtainable from the commercial affinity tag suppliers.

The proteins prepared as described may be used either directly as fusion proteins or, after detachment and removal of the fusion partner, as "pure" hydrophobins.

When a removal of the fusion partner is intended, it is advisable to incorporate a potential cleavage site (specific recognition site for proteases) into the fusion protein between hydrophobin moiety and fusion partner moiety. Suitable cleavage sites are especially those peptide sequences which otherwise occur neither in the hydrophobin moiety nor in the fusion partner moiety, which can be determined easily with bioinformatic tools. Particularly suitable are, for example, BrCN cleavage at methionine, or protease-mediated cleavage with factor Xa cleavage, enterokinase cleavage, thrombin cleavage or TEV (Tobacco etch virus Protease) cleavage.

In the context of the present invention, fuels are understood to mean both fuels in the narrower sense, which are used to operate internal combustion engines, and fuels in general.

Suitable fuels are middle distillates and gasoline fuels. However, preference is given to using middle distillates.

Suitable middle distillates are those which boil in a range of from 120 to 500° C. and are selected, for example, from diesel fuels, kerosene and heating oil. Preferred middle distillates are diesel fuels.

The diesel fuels are, for example, crude oil raffinates which typically have a boiling range of from 100 to 400° C. These are usually distillates having a 95% point up to 360° C. or even higher. However, they may also be "ultra-low sulfur diesel" or "city diesel", characterized by a 95% point of, for example, not more than 345° C. and a sulfur content of not more than 0.005% by weight, or by a 95% point of, for example, 285° C. and a sulfur content of not more than 0.001% by weight. In addition to the diesel fuels obtainable by refining, those which are obtainable by coal gasification or gas liquefaction ("gas-to-liquid" (GTL) fuels) are suitable. Also suitable are mixtures of the aforementioned diesel fuels with renewable fuels such as biodiesel or bioethanol.

The diesel fuels are more preferably those having a low sulfur content, i.e. having a sulfur content of less than 0.05% by weight, preferably of less than 0.02% by weight, in particular of less than 0.005% by weight and especially of less than 0.001% by weight of sulfur. The heating oils are also more preferably those having a low sulfur content, for example having a sulfur content of at most 0.1% by weight, preferably of at most 0.05% by weight, more preferably of at most 0.005% by weight and in particular of at most 0.001% by weight.

Preference is given in accordance with the invention to using hydrophobins or derivatives thereof as defoamers in diesel fuels.

In a further embodiment, the present invention therefore relates to use as described above of at least one hydrophobin or of a derivative thereof as a defoamer, wherein the fuel is a diesel fuel.

According to the invention, the at least one hydrophobin or derivative thereof is used preferably in an amount of from 0.01 to 100 ppm based on the fuel, preferably of from 0.15 to 50 ppm, more preferably of from 0.2 to 30 ppm or from 0.3 to 10 ppm.

In the context of the present application, the unit ppm means mg per kg.

In a further embodiment, the present invention therefore relates to use as described above of at least one hydrophobin or of a derivative thereof as a defoamer, wherein the at least one hydrophobin or derivative thereof is used in an amount of from 0.1 to 100 ppm based on the fuel.

According to the invention, a fuel, especially a diesel fuel, can be defoamed by adding at least one hydrophobin or a derivative thereof.

The present invention therefore also relates to a process for defoaming fuel, comprising the addition of at least one hydrophobin or derivative thereof to a fuel.

In a further embodiment, the present invention relates to a process as described above for defoaming fuel, wherein the fuel is a diesel fuel.

In a further preferred embodiment, the present invention relates to a process as described above for defoaming fuel, wherein the at least one hydrophobin or derivative thereof is used in an amount of from 0.1 to 100 ppm based on the fuel.

It is possible in the context of the present invention that the at least one hydrophobin or derivative thereof is added directly to a fuel or to a fuel composition or in the form of an additive composition.

The present invention further relates to additive compositions which, in addition to at least one further fuel additive, comprise at least one hydrophobin or a derivative thereof. The present invention likewise relates to fuel compositions which comprise at least one hydrophobin or a derivative thereof and at least one further fuel additive.

In a further embodiment, the present invention therefore relates to an additive composition comprising at least one hydrophobin or derivative thereof and at least one further fuel additive.

In a further embodiment, the present invention likewise relates to a fuel composition comprising, in addition to at least one fuel as a main constituent, at least one hydrophobin or derivative thereof and at least one further fuel additive.

The additive composition or the fuel comprise, in addition to the at least one hydrophobin or derivative thereof, at least one further fuel additive, especially at least one detergent and/or a demulsifier. Suitable detergent additives and demulsifiers are listed below. The additive compositions and fuels may also comprise, instead or in addition, various fuel additives such as carrier oils, corrosion inhibitors, antioxidants, antistats, dye markers and the like. However, the additive composition or the fuel preferably comprise at least one detergent and/or a demulsifier and, if appropriate, further different fuel additives.

In a further preferred embodiment, the present invention therefore relates to an additive composition or fuel composition as described above, wherein the composition comprises at least one detergent. In a further preferred embodiment, the present invention likewise relates to an additive composition or fuel composition as described above, wherein the composition comprises at least one demulsifier.

Suitable detergent additives are listed by way of example hereinafter.

The detergent additives are preferably amphiphilic substances which have at least one hydrophobic hydrocarbyl radical having a number-average molecular weight (Mn) of from 85 to 20 000 and at least one polar moiety selected from:

(a) mono- or polyamino groups having up to 6 nitrogen atoms, of which at least one nitrogen atom has basic properties;

(b) nitro groups, if appropriate in combination with hydroxyl groups;

(c) hydroxyl groups in combination with mono- or polyamino groups, in which at least one nitrogen atom has basic properties;

(d) carboxyl groups or their alkali metal or their alkaline earth metal salts;

(e) sulfonic acid groups or their alkali metal or alkaline earth metal salts;

(f) polyoxy-$C_2$- to -$C_4$-alkylene groups which are terminated by hydroxyl groups, mono- or polyamino groups, in which at least one nitrogen atom has basic properties, or by carbamate groups;

(g) carboxylic ester groups;

(h) moieties derived from succinic anhydride and having hydroxyl and/or amino and/or amido and/or imido groups; and/or (i) moieties obtained by Mannich reaction of substituted phenols with aldehydes and mono- or polyamines.

The hydrophobic hydrocarbyl radical in the above detergent additives, which ensures the adequate solubility in the fuel, has a number-average molecular weight (Mn) of from 85 to 20 000, especially from 113 to 10 000, in particular from 300 to 5000. Typical hydrophobic hydrocarbyl radicals, especially in conjunction with the polar moieties (a), (c), (h) and (i), include polypropenyl, polybutenyl and polyisobutenyl radicals each having Mn=from 300 to 5000, especially from 500 to 2500, in particular from 700 to 2300.

Examples of the above groups of detergent additives include the following:

Additives comprising mono- or polyamino groups (a) are preferably polyalkenemono- or polyalkenepolyamines based on polypropene or conventional (i.e. having predominantly internal double bonds) polybutene or polyisobutene having Mn=from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylenetriamine, triethylenetetramine or tetraethylenepentamine. Corresponding additives based on polypropene are described in particular in WO 94/24231.

Further preferred additives comprising monoamino groups (a) are the hydrogenation products of the reaction products of polyisobutenes having an average degree of polymerization P of from 5 to 100 with nitrogen oxides or mixtures of nitrogen oxides and oxygen, as described in particular in WO 97/03946.

Further preferred additives comprising monoamino groups (a) are the compounds obtainable from polyisobutene epoxides by reaction with amines and subsequent dehydration and reduction of the amino alcohols, as described in particular in DE-A 196 20 262.

Additives comprising nitro groups (b), if appropriate in combination with hydroxyl groups, are preferably reaction products of polyisobutenes having an average degree of polymerization P of from 5 to 100 or from 10 to 100 with nitrogen oxides or mixtures of nitrogen oxides and oxygen, as described in particular in WO 96/03367 and WO 96/03479. These reaction products are generally mixtures of pure nitropolyisobutenes (e.g. α,β-dinitropolyisobutene) and mixed hydroxynitropolyisobutenes (e.g. α-nitro-β-hydroxypolyisobutene).

Additives comprising hydroxyl groups in combination with mono- or polyamino groups (c) are in particular reaction products of polyisobutene epoxides obtainable from polyisobutene having preferably predominantly terminal double bonds and Mn from 300 to 5000, with ammonia or mono- or polyamines, as described in particular in EP-A 476 485.

Additives comprising carboxyl groups or their alkali metal or alkaline earth metal salts (d) are preferably copolymers of $C_2$-$C_{40}$-olefins with maleic anhydride which have a total molar mass of from 500 to 20 000 and of whose carboxyl groups some or all have been converted to the alkali metal or alkaline earth metal salts and any remainder of the carboxyl groups has been reacted with alcohols or amines. Such additives are disclosed in particular by EP-A 307 815. Such additives serve mainly to prevent valve seat wear and can, as described in WO 87/01126, advantageously be used in combination with customary fuel detergents such as poly(iso) buteneamines or polyetheramines.

Additives comprising sulfonic acid groups or their alkali metal or alkaline earth metal salts (e) are preferably alkali metal or alkaline earth metal salts of an alkyl sulfosuccinate, as described in particular in EP-A 639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (f) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenois with from 1 to 30 mol of ethylene oxide and/or propylene oxide and/or butylene oxide per hydroxyl group or amino group and, in the case of the polyetheramines, by subsequent reductive amination with ammonia, monoamines or polyamines. Such products are described in particular in EP-A 310 875, EP-A 356 725, EP-A 700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising carboxylic ester groups (g) are preferably esters of mono-, di- or tricarboxylic acids with long-chain alkanols or polyols, in particular those having a minimum viscosity of 2 $mm^2/s$ at 100° C., as described in particular in DE-A 38 38 918. The mono-, di- or tricarboxylic acids used may be aliphatic or aromatic acids, and particularly suitable ester alcohols or ester polyols are long-chain representatives having, for example, from 6 to 24 carbon atoms. Typical representatives of the esters are adipates, phthalates, isophthalates, terephthalates and trimellitates of isooctanol, of isononanol, of isodecanol and of isotridecanol. Such products also have carrier oil properties.

Additives comprising moieties derived from succinic anhydride and having hydroxyl and/or amino and/or amido and/or imido groups (h) are preferably corresponding derivatives of polyisobutenylsuccinic anhydride which are obtainable by reacting conventional or highly reactive polyisobutene having Mn=from 300 to 5000 with maleic anhydride by a thermal route or via the chlorinated polyisobutene. Particular interest attaches to derivatives with aliphatic polyamines such as ethylenediamine, diethylenetriamine, triethylenetetramine or tetraethylenepentamine. The moieties having hydroxyl and/or amino and/or amido and/or imido groups are, for example, carboxylic acid groups, acid amides, acid amides of di- or polyamines which, in addition to the amide function, also have free amine groups, succinic acid derivatives having an acid and an amide function, carboximides with monoamines, carboximides with di- or polyamines which, in addition to the imide function, also have free amine groups, and diimides which are formed by the reaction of di- or polyamines with two succinic acid derivatives. Such fuel additives are described in particular in U.S. Pat. No. 4,849,572.

Additives (i) comprising moieties obtained by Mannich reaction of substituted phenols with aldehydes and mono- or polyamines are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn=from 300 to 5000. Such "polyisobutene-Mannich bases" are described in particular in EP-A 831 141.

For a more precise definition of the fuel additives detailed individually, reference is explicitly made here to the disclosures of the abovementioned prior art documents.

Particular preference is given to detergent additives from group (h). These are in particular polyisobutenyl-substituted succinimides, especially the imides with aliphatic polyamines.

Examples of demulsifiers suitable in accordance with the invention include the following.

Demulsifiers are substances which bring about the demixing of an emulsion. They may be either ionogenic or nonionogenic substances which are effective at the phase boundary. Accordingly, all surface-active substances are in principle suitable as demulsifiers. Particularly suitable demulsifiers are selected from anion-active compounds such as the alkali metal or alkaline earth metal salts of alkyl-substituted phenol- and naphthalenesulfonates and the alkali metal or alkaline earth metal salts of fatty acids, and also uncharged compounds such as alcohol alkoxylates, e.g. alcohol ethoxylates, phenol alkoxylates, e.g. tert-butylphenol ethoxylate or tert-pentylphenol ethoxylate, fatty acids, alkylphenols, condensation products of ethylene oxide (EO) and propylene oxide (PO), for example also in the form of EO/PO block copolymers, polyethyleneimines or else polysiloxanes.

The additive composition and the fuel may additionally be combined with further customary components and additives. Mention should be made here, for example, of carrier oils without marked detergent action, these being employed in particular in the case of use in gasoline fuels. However, they are occasionally also used in middle distillates.

Suitable carrier oils are listed by way of example hereinbelow.

Suitable mineral carrier oils are the fractions obtained in crude oil processing, such as brightstock or base oils having viscosities, for example, from the SN 500-2000 class; and also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized). Likewise suitable are mixtures of abovementioned mineral carrier oils.

Examples of synthetic carrier oils which are useful in accordance with the invention are selected from: polyolefins (poly-alpha-olefins or poly(internal olefin)s), (poly)esters, (poly)alkoxylates, polyethers, aliphatic polyetheramines, alkylphenol-started polyethers, alkylphenol-started polyetheramines and carboxylic esters of long-chain alkanols.

Examples of suitable polyolefins are olefin polymers having Mn=from 400 to 1800, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclo-hexanols or $C_1$-$C_{30}$-alkylphenols with from 1 to 30 mol of ethylene oxide and/or propylene oxide and/or butylene oxide per hydroxyl group or amino group, and, in the case of the polyetheramines, by subsequent reductive amination with ammonia, monoamines or polyamines. Such products are described in particular in EP-A 310 875, EP-A 356 725, EP-A 700 985 and U.S. Pat. No. 4,877,416. For example, the polyetheramines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A 38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A 38 26 608, DE-A 41 42 241, DE-A 43 09 074, EP-A 0 452 328 and EP-A 0 548 617, which are explicitly incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Nonlimiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A 10 102 913.6.

The inventive compositions may, if appropriate, comprise further coadditives.

Further customary additives are additives which improve the cold properties of the fuel, for example nucleators, flow improvers, paraffin dispersants and mixtures thereof, for example ethylene-vinyl acetate copolymers; corrosion inhibitors, for example based on ammonium salts of organic carboxylic acids, said salts tending to form films, or on heterocyclic aromatics in the case of nonferrous metal corrosion protection; dehazers; antifoams, for example certain siloxane compounds; cetane number improvers (ignition improvers); combustion improvers; antioxidants or stabilizers, for example based on amines such as p-phenylenediamine, dicyclohexylamine or derivatives thereof or on phenols such as 2,4-di-tert-butylphenol or 3,5-di-tert-butyl-4-hydroxyphenylpropionic acid; antistats; metallocenes such as ferrocene; methylcyclopentadienylmanganese tricarbonyl; lubricity improvers, for example certain fatty acids, alkenylsuccinic esters, bis(hydroxyalkyl) fatty amines, hydroxyacetamides or castor oil; and also dyes (markers). Amines are also added if appropriate to lower the pH of the fuel.

When detergent additives, for example those having the polar moieties (a) to (i), are used, they are added to the fuel typically in an amount of from 10 to 5000 ppm by weight, in particular from 50 to 1000 ppm by weight, more preferably from 25 to 500 ppm by weight.

When demulsifiers are used, they are added to the fuel typically in an amount of from 0.1 to 100 ppm by weight, in particular from 0.2 to 10 ppm by weight.

The other components and additives mentioned are, if desired, added in amounts customary for this purpose.

When the inventive additive composition comprises a detergent additive, it is present preferably in an amount of from 1 to 60% by weight, preferably from 1 to 50% by weight, more preferably from 1 to 40% by weight and in particular from 1 to 15% by weight, based on the total weight of the composition.

When the inventive additive composition comprises a demulsifier, it is present preferably in an amount of from 0.01 to 5% by weight, more preferably from 0.01 to 2.5% by weight and in particular from 0.01 to 1% by weight, based on the total weight of the composition.

The inventive compositions may also, if appropriate, also comprise a solvent or diluent.

Suitable solvents and diluents are, for example, aromatic and aliphatic hydrocarbons, for example $C_5$-$C_{10}$-alkanes, such as pentane, hexane, heptane, octane, nonane, decane, their constitutional isomers and mixtures; petroleum ether, aromatics such as benzene, toluene, xylenes and Solvent Naphtha; alkanols having from 3 to 8 carbon atoms, for example propanol, isopropanol, n-butanol, sec-butanol, isobutanol and the like, in combination with hydrocarbon solvents; and alkoxyalkanols. Suitable diluents are, for example, also fractions obtained in crude oil processing, such as kerosene, naphtha or brightstock. Diluents used with preference in the case of middle distillates, especially in the case of diesel fuels and heating oils, are naphtha, kerosene, diesel fuels, aromatic hydrocarbons such as Solvent Naphtha heavy, Solvesso® or Shellsol®, and also mixtures of these solvents and diluents.

The individual components may be added to the fuel or to the conventional fuel composition individually or as a concentrate prepared beforehand (additive package; additive composition).

The present invention further also relates to a process for producing at least one fuel composition, wherein a fuel or a fuel composition is admixed (a) with at least one hydrophobin or derivative thereof and at least one further fuel additive or (b) with an additive composition as described above.

Hydrophobins or derivatives thereof have good properties in the defoaming of fuels.

The invention is illustrated hereinbelow by examples.

EXAMPLES

Example 1

Preparations for the Cloning of yaad-$His_6$/yaaE-$His_6$

A polymerase chain reaction was carried out with the aid of the oligonucleotides Hal570 and Hal571 (Hal 572/Hal 573). The template DNA used was genomic DNA of the bacterium *Bacillus subtilis*. The resulting PCR fragment comprised the coding sequence of the *Bacillus subtilis* yaaD/yaaE gene, and an NcoI and BglII restriction cleavage site respectively at each end. The PCR fragment was purified and cut with the restriction endonucleases NcoI and BglII. This DNA fragment was used as an insert and cloned into the vector pQE60 from Qiagen, which had been linearized beforehand with the restriction endonucleases NcoI and BglII. The vectors pQE60YMD#2/pQE60YaaE#5 thus formed may be used to express proteins consisting of YAAD::$HIS_6$ or YAAE::$HIS_6$.

```
                                    (SEQ ID NO: 25)
Hal570: gcgcgcccatggctcaaacaggtactga

                                    (SEQ ID NO: 26)
Hal571: gcagatctccagccgcgttcttgcatac

                                    (SEQ ID NO: 27)
Hal572: ggccatgggattaacaataggtgtactagg

                                    (SEQ ID NO: 28)
Hal573: gcagatcttacaagtgccttttgcttatattcc
```

Example 2

Cloning of yaad Hydrophobin DewA-$His_6$

A polymerase chain reaction was carried out with the aid of the oligonucleotides KaM 416 and KaM 417. The template DNA used was genomic DNA of the mold *Aspergillus nidulans*. The resulting PCR fragment comprised the coding sequence of the hydrophobin gene dewA and an N-terminal factor Xa proteinase cleavage site. The PCR fragment was purified and cut with the restriction endonuclease BamHI. This DNA fragment was used as an insert and cloned into the vector pQE60YAAD#2 which had been linearized beforehand with the restriction endonuclease BglII.

The vector #508 thus formed can be used to express a fusion protein consisting of YAAD::Xa::dewA::$HIS_6$.

```
KaM416:                                 (SEQ ID NO: 29)
GCAGCCCATCAGGGATCCCTCAGCCTTGGTACCAGCGC

KaM417:                                 (SEQ ID NO: 30)
CCCGTAGCTAGTGGATCCATTGAAGGCCGCATGAAGTTCTCCGTCTCCGC
```

Example 3

Cloning of yaad Hydrophobin RodA-$His_6$

The plasmid #513 was cloned analogously to plasmid #508 using the oligonucleotides KaM 434 and KaM 435.

```
KaM434:                                 (SEQ ID NO: 31)
GCTAAGCGGATCCATTGAAGGCCGCATGAAGTTCTCCATTGCTGC

KaM435:                                 (SEQ ID NO: 32)
CCAATGGGGATCCGAGGATGGAGCCAAGGG
```

Example 4

Cloning of yaad Hydrophobin BASF1-$His_6$

The plasmid #507 was cloned analogously to plasmid #508 using the oligonucleotides KaM 417 and KaM 418.

The template DNA used was a synthetic DNA sequence (hydrophobin BASF1) (see appendix, SEQ ID NO. 11 and 12).

```
KaM417:                                 (SEQ ID NO: 30)
CCCGTAGCTAGTGGATCCATTGAAGGCCGCATGAAGTTCTCCGTCTCCGC

KaM418:                                 (SEQ ID NO: 33)
CTGCCATTCAGGGGATCCCATATGGAGGAGGGAGACAG
```

Example 5

Cloning of yaad Hydrophobin BASF2-$His_6$

The plasmid #506 was cloned analogously to plasmid #508 using the oligonucleotides KaM 417 and KaM 418.

The template DNA used was a synthetic DNA sequence (hydrophobin BASF2) (see appendix, SEQ ID NO. 13 and 14).

```
KaM417:                                 (SEQ ID NO: 30)
CCCGTAGCTAGTGGATCCATTGAAGGCCGCATGAAGTTCTCCGTCTCCGC

KaM418:                                 (SEQ ID NO: 33)
CTGCCATTCAGGGGATCCCATATGGAGGAGGGAGACAG
```

Example 6

Cloning of yaad Hydrophobin SC3-$His_6$

The plasmid #526 was cloned analogously to plasmid #508 using the oligonucleotides KaM464 and KaM465.

The template DNA used was cDNA from *Schyzophyllum commune* (see appendix, SEQ ID NO. 9 and 10).

```
                                        (SEQ ID NO: 34)
KaM464: CGTTAAGGATCCGAGGATGTTGATGGGGGTGC

                                        (SEQ ID NO: 35)
KaM465: GCTAACAGATCTATGTTCGCCCGTCTCCCCGTCGT
```

Example 7

Fermentation of the Recombinant *E. coli* Strain yaad Hydrophobin DewA-$His_6$

Inoculation of 3 ml of LB liquid medium with a yaad hydrophobin DewA-$His_6$-expressing *E. coli* strain in 15 ml Greiner tubes. Inoculation for 8 h at 37° C. on a shaker at 200 rpm. In each case two 1 l Erlenmeyer flasks with baffles and 250 ml of LB medium (+100 μg/ml of ampicillin) are inoculated with 1 ml in each case of the preliminary culture and incubated for 9 h at 37° C. on a shaker at 180 rpm.

Inoculate 13.5 l of LB medium (+100 μg/ml of ampicillin) with 0.5 l of preliminary culture ($OD_{600\ nm}$ 1:10, measured against $H_2O$) in a 20 l fermenter. At an $OD_{60\ nm}$ of ~3.5, addition of 140 ml of 100 mM IPTG. After 3 h, cool fermenter to 10° C. and centrifuge off fermentation broth. Use cell pellet for further purification.

Example 8

Purification of the Recombinant Hydrophobin Fusion Protein (Purification of Hydrophobin Fusion Proteins which have a C-Terminal His6 Tag)

100 g of cell pellet (100-500 mg of hydrophobin) are made up to total volume 200 ml with 50 mM sodium phosphate buffer, pH 7.5, and resuspended. The suspension is treated with an Ultraturrax type T25 (Janke and Kunkel; IKA-Labortechnik) for 10 minutes and subsequently incubated with 500 units of Benzonase (Merck, Darmstadt; order No. 1.01697.0001) at room temperature for 1 hour to degrade the nucleic acids. Before the cell disruption, filtration is effected with a glass cartridge (P1). For cell disruption and for the scission of the remaining genomic DNA, two homogenizer cycles are carried out 1500 bar (Microfluidizer M-110EH; Microfluidics Corp.). The homogenate is centrifuged (Sorvall RC-5B, GSA rotor, 250 ml centrifuge cup, 60 minutes, 4° C., 12 000 rpm, 23 000 g), the supernatant was placed on ice and the pellet was resuspended in 100 ml of sodium phosphate buffer, pH 7.5. Centrifugation and resuspension are repeated three times, the sodium phosphate buffer comprising 1% SDS at the third repetition. After the resuspension, the mixture is stirred for 1 hour and a final centrifugation is carried out (Sorvall RC-5B, GSA rotor, 250 ml centrifuge cup, 60 minutes, 4° C., 12 000 rpm, 23 000 g). According to SDS-PAGE analysis, the hydrophobin is present in the supernatant after the final centrifugation (FIG. 1). The experiments show that the hydrophobin is probably present in the form of inclusion bodies in the corresponding *E. coli* cells. 50 ml of the hydrophobin-comprising supernatant are applied to a 50 ml nickel Sepharose High Performance 17-5268-02 column (Amersham) which has been equilibrated with 50 mM Tris-Cl pH 8.0 buffer. The column is washed with 50 mM Tris-Cl pH 8.0 buffer and the hydrophobin is subsequently eluted with 50 mM Tris-Cl pH 8.0 buffer which comprises 200 mM imidazole. To remove the imidazole, the solution is dialyzed against 50 mM Tris-Cl pH 8.0 buffer.

FIG. 1 shows the purification of the hydrophobin prepared:

Lane A: Application to nickel Sepharose column (1:10 dilution)

Lane B: Flow-through=washing step eluate

Lanes C-E: OD 280 Maxima of the elution fractions (WP1, WP2, WP3)

Lane F shows the applied marker.

The hydrophobin of FIG. 1 has a molecular weight of approx. 53 kD. Some of the smaller bands represent degradation products of the hydrophobin.

Example 9

Performance Testing; Characterization of the Hydrophobin by Change in Contact Angle of a Water Drop on Glass Substrate:

Glass (window glass, Süddeutsche Glas, Mannheim):

hydrophobin concentration: 100 μg/ml incubation of glass plates overnight (temperature 80° C.) in 50 mM sodium acetate pH 4+0.1% Tween 20 then wash coating in distilled water then incubation 10 min/80° C./1% SDS solution in dist. water Wash in dist. water The samples are dried under air and the contact angle (in degrees) of a drop of 5 μl of water is determined.

The contact angle was measured on a Dataphysics Contact Angle System OCA 15+, Software SCA 20.2.0. (November 2002). The measurement was effected in accordance with the manufacturer's instructions.

Untreated glass gave a contact angle of 30±5°; a coating with the functional hydrophobin according to example 8 (yaad-dewA-$his_6$) gave contact angles of 75±5°.

Example 10

Use of a Hydrophobin Concentrate (Yaad-dewA-$His_6$) as a Defoamer

The improvement in defoaming was carried out by means of a hand-shake foaming test as follows:

100 ml of fuel or additized fuel were introduced into a 250 ml screwtop glass bottle which was sealed tightly;

the sample was shaken for 2 min, the sample was then put down immediately and the volume of the foam (ml) the decomposition time of the foam (sec) were determined.

For the experiment, a hydrophobin concentrate (Yaad-dewA-$His_6$, as a solution in $NaH_2PO_4$ buffer (50 mmol/L, pH 7.5)) was used. The starting sample had a concentration of 6.1 mg/ml of hydrophobin. 2 mL of the starting sample were made up to 100 ml (Hyd. sol. 1), and 3 mL of the resulting solution were added to 97 mL of fuel (EN 590 fuel). The results of the experiment are reproduced in the table which follows.

| | | | Foam according to Repsol | |
|---|---|---|---|---|
| | Dosage | DK | Volume | Break time |
| Unadditized | | 976 | 10 | 18 |
| Hyd. sol 2 | 3 mL | 976 | 0 | 0 |

The amount of foam and the foam decomposition time were lower in the case of additization with the hydrophobin concentrate than when the diesel fuel did not comprise any hydrophobin.

SEQUENCE LISTING

<160> NUMBER OF SEQ ID NOS: 35

<210> SEQ ID NO 1
<211> LENGTH: 405
<212> TYPE: DNA
<213> ORGANISM: Aspergillus nidulans
<220> FEATURE:
<221> NAME/KEY: CDS
<222> LOCATION: (1)..(405)
<223> OTHER INFORMATION: basf-dewA

<400> SEQUENCE: 1

```
atg cgc ttc atc gtc tct ctc ctc gcc ttc act gcc gcg gcc acc gcg       48
Met Arg Phe Ile Val Ser Leu Leu Ala Phe Thr Ala Ala Ala Thr Ala
1               5                   10                  15

acc gcc ctc ccg gcc tct gcc gca aag aac gcg aag ctg gcc acc tcg       96
Thr Ala Leu Pro Ala Ser Ala Ala Lys Asn Ala Lys Leu Ala Thr Ser
            20                  25                  30

gcg gcc ttc gcc aag cag gct gaa ggc acc acc tgc aat gtc ggc tcg      144
Ala Ala Phe Ala Lys Gln Ala Glu Gly Thr Thr Cys Asn Val Gly Ser
        35                  40                  45

atc gct tgc tgc aac tcc ccc gct gag acc aac aac gac agt ctg ttg      192
Ile Ala Cys Cys Asn Ser Pro Ala Glu Thr Asn Asn Asp Ser Leu Leu
    50                  55                  60

agc ggt ctg ctc ggt gct ggc ctt ctc aac ggg ctc tcg ggc aac act      240
Ser Gly Leu Leu Gly Ala Gly Leu Leu Asn Gly Leu Ser Gly Asn Thr
65                  70                  75                  80

ggc agc gcc tgc gcc aag gcg agc ttg att gac cag ctg ggt ctg ctc      288
Gly Ser Ala Cys Ala Lys Ala Ser Leu Ile Asp Gln Leu Gly Leu Leu
                85                  90                  95

gct ctc gtc gac cac act gag gaa ggc ccc gtc tgc aag aac atc gtc      336
Ala Leu Val Asp His Thr Glu Glu Gly Pro Val Cys Lys Asn Ile Val
            100                 105                 110

gct tgc tgc cct gag gga acc acc aac tgt gtt gcc gtc gac aac gct      384
Ala Cys Cys Pro Glu Gly Thr Thr Asn Cys Val Ala Val Asp Asn Ala
        115                 120                 125

ggc gct ggt acc aag gct gag                                          405
Gly Ala Gly Thr Lys Ala Glu
    130                 135
```

<210> SEQ ID NO 2
<211> LENGTH: 135
<212> TYPE: PRT
<213> ORGANISM: Aspergillus nidulans

<400> SEQUENCE: 2

```
Met Arg Phe Ile Val Ser Leu Leu Ala Phe Thr Ala Ala Ala Thr Ala
1               5                   10                  15

Thr Ala Leu Pro Ala Ser Ala Ala Lys Asn Ala Lys Leu Ala Thr Ser
            20                  25                  30

Ala Ala Phe Ala Lys Gln Ala Glu Gly Thr Thr Cys Asn Val Gly Ser
        35                  40                  45

Ile Ala Cys Cys Asn Ser Pro Ala Glu Thr Asn Asn Asp Ser Leu Leu
    50                  55                  60

Ser Gly Leu Leu Gly Ala Gly Leu Leu Asn Gly Leu Ser Gly Asn Thr
65                  70                  75                  80

Gly Ser Ala Cys Ala Lys Ala Ser Leu Ile Asp Gln Leu Gly Leu Leu
                85                  90                  95

Ala Leu Val Asp His Thr Glu Glu Gly Pro Val Cys Lys Asn Ile Val
            100                 105                 110
```

```
Ala Cys Cys Pro Glu Gly Thr Thr Asn Cys Val Ala Val Asp Asn Ala
        115                 120                 125

Gly Ala Gly Thr Lys Ala Glu
    130                 135


<210> SEQ ID NO 3
<211> LENGTH: 471
<212> TYPE: DNA
<213> ORGANISM: Aspergillus nidulans
<220> FEATURE:
<221> NAME/KEY: CDS
<222> LOCATION: (1)..(471)
<223> OTHER INFORMATION: basf-rodA

<400> SEQUENCE: 3

atg aag ttc tcc att gct gcc gct gtc gtt gct ttc gcc gcc tcc gtc       48
Met Lys Phe Ser Ile Ala Ala Ala Val Val Ala Phe Ala Ala Ser Val
1               5                   10                  15

gcg gcc ctc cct cct gcc cat gat tcc cag ttc gct ggc aat ggt gtt       96
Ala Ala Leu Pro Pro Ala His Asp Ser Gln Phe Ala Gly Asn Gly Val
            20                  25                  30

ggc aac aag ggc aac agc aac gtc aag ttc cct gtc ccc gaa aac gtg      144
Gly Asn Lys Gly Asn Ser Asn Val Lys Phe Pro Val Pro Glu Asn Val
        35                  40                  45

acc gtc aag cag gcc tcc gac aag tgc ggt gac cag gcc cag ctc tct      192
Thr Val Lys Gln Ala Ser Asp Lys Cys Gly Asp Gln Ala Gln Leu Ser
    50                  55                  60

tgc tgc aac aag gcc acg tac gcc ggt gac acc aca acc gtt gat gag      240
Cys Cys Asn Lys Ala Thr Tyr Ala Gly Asp Thr Thr Thr Val Asp Glu
65                  70                  75                  80

ggt ctt ctg tct ggt gcc ctc agc ggc ctc atc ggc gcc ggg tct ggt      288
Gly Leu Leu Ser Gly Ala Leu Ser Gly Leu Ile Gly Ala Gly Ser Gly
                85                  90                  95

gcc gaa ggt ctt ggt ctc ttc gat cag tgc tcc aag ctt gat gtt gct      336
Ala Glu Gly Leu Gly Leu Phe Asp Gln Cys Ser Lys Leu Asp Val Ala
            100                 105                 110

gtc ctc att ggc atc caa gat ctt gtc aac cag aag tgc aag caa aac      384
Val Leu Ile Gly Ile Gln Asp Leu Val Asn Gln Lys Cys Lys Gln Asn
        115                 120                 125

att gcc tgc tgc cag aac tcc ccc tcc agc gcg gat ggc aac ctt att      432
Ile Ala Cys Cys Gln Asn Ser Pro Ser Ser Ala Asp Gly Asn Leu Ile
    130                 135                 140

ggt gtc ggt ctc cct tgc gtt gcc ctt ggc tcc atc ctc                  471
Gly Val Gly Leu Pro Cys Val Ala Leu Gly Ser Ile Leu
145                 150                 155


<210> SEQ ID NO 4
<211> LENGTH: 157
<212> TYPE: PRT
<213> ORGANISM: Aspergillus nidulans

<400> SEQUENCE: 4

Met Lys Phe Ser Ile Ala Ala Ala Val Val Ala Phe Ala Ala Ser Val
1               5                   10                  15

Ala Ala Leu Pro Pro Ala His Asp Ser Gln Phe Ala Gly Asn Gly Val
            20                  25                  30

Gly Asn Lys Gly Asn Ser Asn Val Lys Phe Pro Val Pro Glu Asn Val
        35                  40                  45

Thr Val Lys Gln Ala Ser Asp Lys Cys Gly Asp Gln Ala Gln Leu Ser
    50                  55                  60

Cys Cys Asn Lys Ala Thr Tyr Ala Gly Asp Thr Thr Thr Val Asp Glu
```

```
65                  70                  75                  80

Gly Leu Leu Ser Gly Ala Leu Ser Gly Leu Ile Gly Ala Gly Ser Gly
                85                  90                  95

Ala Glu Gly Leu Gly Leu Phe Asp Gln Cys Ser Lys Leu Asp Val Ala
            100                 105                 110

Val Leu Ile Gly Ile Gln Asp Leu Val Asn Gln Lys Cys Lys Gln Asn
        115                 120                 125

Ile Ala Cys Cys Gln Asn Ser Pro Ser Ser Ala Asp Gly Asn Leu Ile
    130                 135                 140

Gly Val Gly Leu Pro Cys Val Ala Leu Gly Ser Ile Leu
145                 150                 155


<210> SEQ ID NO 5
<211> LENGTH: 336
<212> TYPE: DNA
<213> ORGANISM: Unknown
<220> FEATURE:
<221> NAME/KEY: CDS
<222> LOCATION: (1)..(336)
<223> OTHER INFORMATION: basf-HypA

<400> SEQUENCE: 5

atg atc tct cgc gtc ctt gtc gct gct ctc gtc gct ctc ccc gct ctt       48
Met Ile Ser Arg Val Leu Val Ala Ala Leu Val Ala Leu Pro Ala Leu
1               5                   10                  15

gtt act gca act cct gct ccc gga aag cct aaa gcc agc agt cag tgc       96
Val Thr Ala Thr Pro Ala Pro Gly Lys Pro Lys Ala Ser Ser Gln Cys
            20                  25                  30

gac gtc ggt gaa atc cat tgc tgt gac act cag cag act ccc gac cac      144
Asp Val Gly Glu Ile His Cys Cys Asp Thr Gln Gln Thr Pro Asp His
        35                  40                  45

acc agc gcc gcc gcg tct ggt ttg ctt ggt gtt ccc atc aac ctt ggt      192
Thr Ser Ala Ala Ala Ser Gly Leu Leu Gly Val Pro Ile Asn Leu Gly
    50                  55                  60

gct ttc ctc ggt ttc gac tgt acc ccc att tcc gtc ctt ggc gtc ggt      240
Ala Phe Leu Gly Phe Asp Cys Thr Pro Ile Ser Val Leu Gly Val Gly
65                  70                  75                  80

ggc aac aac tgt gct gct cag cct gtc tgc tgc aca gga aat caa ttc      288
Gly Asn Asn Cys Ala Ala Gln Pro Val Cys Cys Thr Gly Asn Gln Phe
                85                  90                  95

acc gca ttg att aac gct ctt gac tgc tct cct gtc aat gtc aac ctc      336
Thr Ala Leu Ile Asn Ala Leu Asp Cys Ser Pro Val Asn Val Asn Leu
            100                 105                 110


<210> SEQ ID NO 6
<211> LENGTH: 112
<212> TYPE: PRT
<213> ORGANISM: Unknown
<220> FEATURE:
<223> OTHER INFORMATION: basf-HypA

<400> SEQUENCE: 6

Met Ile Ser Arg Val Leu Val Ala Ala Leu Val Ala Leu Pro Ala Leu
1               5                   10                  15

Val Thr Ala Thr Pro Ala Pro Gly Lys Pro Lys Ala Ser Ser Gln Cys
            20                  25                  30

Asp Val Gly Glu Ile His Cys Cys Asp Thr Gln Gln Thr Pro Asp His
        35                  40                  45

Thr Ser Ala Ala Ala Ser Gly Leu Leu Gly Val Pro Ile Asn Leu Gly
    50                  55                  60

Ala Phe Leu Gly Phe Asp Cys Thr Pro Ile Ser Val Leu Gly Val Gly
```

```
65                  70                  75                  80

Gly Asn Asn Cys Ala Ala Gln Pro Val Cys Cys Thr Gly Asn Gln Phe
                85                  90                  95

Thr Ala Leu Ile Asn Ala Leu Asp Cys Ser Pro Val Asn Val Asn Leu
            100                 105                 110


<210> SEQ ID NO 7
<211> LENGTH: 357
<212> TYPE: DNA
<213> ORGANISM: Unknown
<220> FEATURE:
<221> NAME/KEY: CDS
<222> LOCATION: (1)..(357)
<223> OTHER INFORMATION: basf-HypB

<400> SEQUENCE: 7

atg gtc agc acg ttc atc act gtc gca aag acc ctt ctc gtc gcg ctc       48
Met Val Ser Thr Phe Ile Thr Val Ala Lys Thr Leu Leu Val Ala Leu
1               5                   10                  15

ctc ttc gtc aat atc aat atc gtc gtt ggt act gca act acc ggc aag       96
Leu Phe Val Asn Ile Asn Ile Val Val Gly Thr Ala Thr Thr Gly Lys
            20                  25                  30

cat tgt agc acc ggt cct atc gag tgc tgc aag cag gtc atg gat tct      144
His Cys Ser Thr Gly Pro Ile Glu Cys Cys Lys Gln Val Met Asp Ser
        35                  40                  45

aag agc cct cag gct acg gag ctt ctt acg aag aat ggc ctt ggc ctg      192
Lys Ser Pro Gln Ala Thr Glu Leu Leu Thr Lys Asn Gly Leu Gly Leu
    50                  55                  60

ggt gtc ctt gct ggc gtg aag ggt ctt gtt ggc gcg aat tgc agc cct      240
Gly Val Leu Ala Gly Val Lys Gly Leu Val Gly Ala Asn Cys Ser Pro
65                  70                  75                  80

atc acg gca att ggt att ggc tcc ggc agc caa tgc tct ggc cag acc      288
Ile Thr Ala Ile Gly Ile Gly Ser Gly Ser Gln Cys Ser Gly Gln Thr
                85                  90                  95

gtt tgc tgc cag aat aat aat ttc aac ggt gtt gtc gct att ggt tgc      336
Val Cys Cys Gln Asn Asn Asn Phe Asn Gly Val Val Ala Ile Gly Cys
            100                 105                 110

act ccc att aat gcc aat gtg                                          357
Thr Pro Ile Asn Ala Asn Val
        115


<210> SEQ ID NO 8
<211> LENGTH: 119
<212> TYPE: PRT
<213> ORGANISM: Unknown
<220> FEATURE:
<223> OTHER INFORMATION: basf-HypB

<400> SEQUENCE: 8

Met Val Ser Thr Phe Ile Thr Val Ala Lys Thr Leu Leu Val Ala Leu
1               5                   10                  15

Leu Phe Val Asn Ile Asn Ile Val Val Gly Thr Ala Thr Thr Gly Lys
            20                  25                  30

His Cys Ser Thr Gly Pro Ile Glu Cys Cys Lys Gln Val Met Asp Ser
        35                  40                  45

Lys Ser Pro Gln Ala Thr Glu Leu Leu Thr Lys Asn Gly Leu Gly Leu
    50                  55                  60

Gly Val Leu Ala Gly Val Lys Gly Leu Val Gly Ala Asn Cys Ser Pro
65                  70                  75                  80

Ile Thr Ala Ile Gly Ile Gly Ser Gly Ser Gln Cys Ser Gly Gln Thr
                85                  90                  95
```

```
Val Cys Cys Gln Asn Asn Asn Phe Asn Gly Val Val Ala Ile Gly Cys
            100                 105                 110

Thr Pro Ile Asn Ala Asn Val
        115


<210> SEQ ID NO 9
<211> LENGTH: 408
<212> TYPE: DNA
<213> ORGANISM: Schyzophyllum commune
<220> FEATURE:
<221> NAME/KEY: CDS
<222> LOCATION: (1)..(408)
<223> OTHER INFORMATION: basf-sc3

<400> SEQUENCE: 9

atg ttc gcc cgt ctc ccc gtc gtg ttc ctc tac gcc ttc gtc gcg ttc       48
Met Phe Ala Arg Leu Pro Val Val Phe Leu Tyr Ala Phe Val Ala Phe
1               5                   10                  15

ggc gcc ctc gtc gct gcc ctc cca ggt ggc cac ccg ggc acg acc acg       96
Gly Ala Leu Val Ala Ala Leu Pro Gly Gly His Pro Gly Thr Thr Thr
            20                  25                  30

ccg ccg gtt acg acg acg gtg acg gtg acc acg ccg ccc tcg acg acg      144
Pro Pro Val Thr Thr Thr Val Thr Val Thr Thr Pro Pro Ser Thr Thr
        35                  40                  45

acc atc gcc gcc ggt ggc acg tgt act acg ggg tcg ctc tct tgc tgc      192
Thr Ile Ala Ala Gly Gly Thr Cys Thr Thr Gly Ser Leu Ser Cys Cys
    50                  55                  60

aac cag gtt caa tcg gcg agc agc agc cct gtt acc gcc ctc ctc ggc      240
Asn Gln Val Gln Ser Ala Ser Ser Ser Pro Val Thr Ala Leu Leu Gly
65                  70                  75                  80

ctg ctc ggc att gtc ctc agc gac ctc aac gtt ctc gtt ggc atc agc      288
Leu Leu Gly Ile Val Leu Ser Asp Leu Asn Val Leu Val Gly Ile Ser
                85                  90                  95

tgc tct ccc ctc act gtc atc ggt gtc gga ggc agc ggc tgt tcg gcg      336
Cys Ser Pro Leu Thr Val Ile Gly Val Gly Gly Ser Gly Cys Ser Ala
            100                 105                 110

cag acc gtc tgc tgc gaa aac acc caa ttc aac ggg ctg atc aac atc      384
Gln Thr Val Cys Cys Glu Asn Thr Gln Phe Asn Gly Leu Ile Asn Ile
        115                 120                 125

ggt tgc acc ccc atc aac atc ctc                                      408
Gly Cys Thr Pro Ile Asn Ile Leu
    130                 135


<210> SEQ ID NO 10
<211> LENGTH: 136
<212> TYPE: PRT
<213> ORGANISM: Schyzophyllum commune
<220> FEATURE:
<223> OTHER INFORMATION: basf-sc3

<400> SEQUENCE: 10

Met Phe Ala Arg Leu Pro Val Val Phe Leu Tyr Ala Phe Val Ala Phe
1               5                   10                  15

Gly Ala Leu Val Ala Ala Leu Pro Gly Gly His Pro Gly Thr Thr Thr
            20                  25                  30

Pro Pro Val Thr Thr Thr Val Thr Val Thr Thr Pro Pro Ser Thr Thr
        35                  40                  45

Thr Ile Ala Ala Gly Gly Thr Cys Thr Thr Gly Ser Leu Ser Cys Cys
    50                  55                  60

Asn Gln Val Gln Ser Ala Ser Ser Ser Pro Val Thr Ala Leu Leu Gly
65                  70                  75                  80

Leu Leu Gly Ile Val Leu Ser Asp Leu Asn Val Leu Val Gly Ile Ser
```

```
                85                  90                  95

Cys Ser Pro Leu Thr Val Ile Gly Val Gly Gly Ser Gly Cys Ser Ala
            100                 105                 110

Gln Thr Val Cys Cys Glu Asn Thr Gln Phe Asn Gly Leu Ile Asn Ile
        115                 120                 125

Gly Cys Thr Pro Ile Asn Ile Leu
    130                 135


<210> SEQ ID NO 11
<211> LENGTH: 483
<212> TYPE: DNA
<213> ORGANISM: Artificial sequence
<220> FEATURE:
<221> NAME/KEY: CDS
<222> LOCATION: (1)..(483)
<223> OTHER INFORMATION: basf1

<400> SEQUENCE: 11

atg aag ttc tcc gtc tcc gcc gcc gtc ctc gcc ttc gcc gcc tcc gtc       48
Met Lys Phe Ser Val Ser Ala Ala Val Leu Ala Phe Ala Ala Ser Val
1               5                   10                  15

gcc gcc ctc cct cag cac gac tcc gcc gcc ggc aac ggc aac ggc gtc       96
Ala Ala Leu Pro Gln His Asp Ser Ala Ala Gly Asn Gly Asn Gly Val
            20                  25                  30

ggc aac aag ttc cct gtc cct gac gac gtc acc gtc aag cag gcc acc      144
Gly Asn Lys Phe Pro Val Pro Asp Asp Val Thr Val Lys Gln Ala Thr
        35                  40                  45

gac aag tgc ggc gac cag gcc cag ctc tcc tgc tgc aac aag gcc acc      192
Asp Lys Cys Gly Asp Gln Ala Gln Leu Ser Cys Cys Asn Lys Ala Thr
    50                  55                  60

tac gcc ggc gac gtc ctc acc gac atc gac gag ggc atc ctc gcc ggc      240
Tyr Ala Gly Asp Val Leu Thr Asp Ile Asp Glu Gly Ile Leu Ala Gly
65                  70                  75                  80

ctc ctc aag aac ctc atc ggc ggc ggc tcc ggc tcc gag ggc ctc ggc      288
Leu Leu Lys Asn Leu Ile Gly Gly Gly Ser Gly Ser Glu Gly Leu Gly
                85                  90                  95

ctc ttc gac cag tgc gtc aag ctc gac ctc cag atc tcc gtc atc ggc      336
Leu Phe Asp Gln Cys Val Lys Leu Asp Leu Gln Ile Ser Val Ile Gly
            100                 105                 110

atc cct atc cag gac ctc ctc aac cag gtc aac aag cag tgc aag cag      384
Ile Pro Ile Gln Asp Leu Leu Asn Gln Val Asn Lys Gln Cys Lys Gln
        115                 120                 125

aac atc gcc tgc tgc cag aac tcc cct tcc gac gcc acc ggc tcc ctc      432
Asn Ile Ala Cys Cys Gln Asn Ser Pro Ser Asp Ala Thr Gly Ser Leu
    130                 135                 140

gtc aac ctc ggc ctc ggc aac cct tgc atc cct gtc tcc ctc ctc cat      480
Val Asn Leu Gly Leu Gly Asn Pro Cys Ile Pro Val Ser Leu Leu His
145                 150                 155                 160

atg                                                                  483
Met


<210> SEQ ID NO 12
<211> LENGTH: 161
<212> TYPE: PRT
<213> ORGANISM: Unknown
<220> FEATURE:
<223> OTHER INFORMATION: basf1

<400> SEQUENCE: 12

Met Lys Phe Ser Val Ser Ala Ala Val Leu Ala Phe Ala Ala Ser Val
1               5                   10                  15

Ala Ala Leu Pro Gln His Asp Ser Ala Ala Gly Asn Gly Asn Gly Val
```

```
            20                  25                  30

Gly Asn Lys Phe Pro Val Pro Asp Asp Val Thr Val Lys Gln Ala Thr
        35                  40                  45

Asp Lys Cys Gly Asp Gln Ala Gln Leu Ser Cys Cys Asn Lys Ala Thr
    50                  55                  60

Tyr Ala Gly Asp Val Leu Thr Asp Ile Asp Glu Gly Ile Leu Ala Gly
65                  70                  75                  80

Leu Leu Lys Asn Leu Ile Gly Gly Gly Ser Gly Ser Glu Gly Leu Gly
                85                  90                  95

Leu Phe Asp Gln Cys Val Lys Leu Asp Leu Gln Ile Ser Val Ile Gly
            100                 105                 110

Ile Pro Ile Gln Asp Leu Leu Asn Gln Val Asn Lys Gln Cys Lys Gln
        115                 120                 125

Asn Ile Ala Cys Cys Gln Asn Ser Pro Ser Asp Ala Thr Gly Ser Leu
    130                 135                 140

Val Asn Leu Gly Leu Gly Asn Pro Cys Ile Pro Val Ser Leu Leu His
145                 150                 155                 160

Met


<210> SEQ ID NO 13
<211> LENGTH: 465
<212> TYPE: DNA
<213> ORGANISM: Artificial Sequence
<220> FEATURE:
<221> NAME/KEY: CDS
<222> LOCATION: (1)..(465)
<223> OTHER INFORMATION: basf2

<400> SEQUENCE: 13

atg aag ttc tcc gtc tcc gcc gcc gtc ctc gcc ttc gcc gcc tcc gtc       48
Met Lys Phe Ser Val Ser Ala Ala Val Leu Ala Phe Ala Ala Ser Val
1               5                   10                  15

gcc gcc ctc cct cag cac gac tcc gcc gcc ggc aac ggc aac ggc gtc       96
Ala Ala Leu Pro Gln His Asp Ser Ala Ala Gly Asn Gly Asn Gly Val
            20                  25                  30

ggc aac aag ttc cct gtc cct gac gac gtc acc gtc aag cag gcc acc      144
Gly Asn Lys Phe Pro Val Pro Asp Asp Val Thr Val Lys Gln Ala Thr
        35                  40                  45

gac aag tgc ggc gac cag gcc cag ctc tcc tgc tgc aac aag gcc acc      192
Asp Lys Cys Gly Asp Gln Ala Gln Leu Ser Cys Cys Asn Lys Ala Thr
    50                  55                  60

tac gcc ggc gac gtc acc gac atc gac gag ggc atc ctc gcc ggc ctc      240
Tyr Ala Gly Asp Val Thr Asp Ile Asp Glu Gly Ile Leu Ala Gly Leu
65                  70                  75                  80

ctc aag aac ctc atc ggc ggc ggc tcc ggc tcc gag ggc ctc ggc ctc      288
Leu Lys Asn Leu Ile Gly Gly Gly Ser Gly Ser Glu Gly Leu Gly Leu
                85                  90                  95

ttc gac cag tgc gtc aag ctc gac ctc cag atc tcc gtc atc ggc atc      336
Phe Asp Gln Cys Val Lys Leu Asp Leu Gln Ile Ser Val Ile Gly Ile
            100                 105                 110

cct atc cag gac ctc ctc aac cag cag tgc aag cag aac atc gcc tgc      384
Pro Ile Gln Asp Leu Leu Asn Gln Gln Cys Lys Gln Asn Ile Ala Cys
        115                 120                 125

tgc cag aac tcc cct tcc gac gcc acc ggc tcc ctc gtc aac ctc ggc      432
Cys Gln Asn Ser Pro Ser Asp Ala Thr Gly Ser Leu Val Asn Leu Gly
    130                 135                 140

aac cct tgc atc cct gtc tcc ctc ctc cat atg                          465
Asn Pro Cys Ile Pro Val Ser Leu Leu His Met
145                 150                 155
```

<210> SEQ ID NO 14
<211> LENGTH: 155
<212> TYPE: PRT
<213> ORGANISM: Artificial Sequence
<220> FEATURE:
<223> OTHER INFORMATION: basf2

<400> SEQUENCE: 14

```
Met Lys Phe Ser Val Ser Ala Ala Val Leu Ala Phe Ala Ala Ser Val
1               5                   10                  15

Ala Ala Leu Pro Gln His Asp Ser Ala Ala Gly Asn Gly Asn Gly Val
            20                  25                  30

Gly Asn Lys Phe Pro Val Pro Asp Asp Val Thr Val Lys Gln Ala Thr
        35                  40                  45

Asp Lys Cys Gly Asp Gln Ala Gln Leu Ser Cys Cys Asn Lys Ala Thr
    50                  55                  60

Tyr Ala Gly Asp Val Thr Asp Ile Asp Glu Gly Ile Leu Ala Gly Leu
65                  70                  75                  80

Leu Lys Asn Leu Ile Gly Gly Gly Ser Gly Ser Glu Gly Leu Gly Leu
                85                  90                  95

Phe Asp Gln Cys Val Lys Leu Asp Leu Gln Ile Ser Val Ile Gly Ile
            100                 105                 110

Pro Ile Gln Asp Leu Leu Asn Gln Gln Cys Lys Gln Asn Ile Ala Cys
        115                 120                 125

Cys Gln Asn Ser Pro Ser Asp Ala Thr Gly Ser Leu Val Asn Leu Gly
    130                 135                 140

Asn Pro Cys Ile Pro Val Ser Leu Leu His Met
145                 150                 155
```

<210> SEQ ID NO 15
<211> LENGTH: 882
<212> TYPE: DNA
<213> ORGANISM: Artificial sequence
<220> FEATURE:
<221> NAME/KEY: CDS
<222> LOCATION: (1)..(882)
<223> OTHER INFORMATION: basf-yaad

<400> SEQUENCE: 15

```
atg gct caa aca ggt act gaa cgt gta aaa cgc gga atg gca gaa atg       48
Met Ala Gln Thr Gly Thr Glu Arg Val Lys Arg Gly Met Ala Glu Met
1               5                   10                  15

caa aaa ggc ggc gtc atc atg gac gtc atc aat gcg gaa caa gcg aaa       96
Gln Lys Gly Gly Val Ile Met Asp Val Ile Asn Ala Glu Gln Ala Lys
            20                  25                  30

atc gct gaa gaa gct gga gct gtc gct gta atg gcg cta gaa cgt gtg      144
Ile Ala Glu Glu Ala Gly Ala Val Ala Val Met Ala Leu Glu Arg Val
        35                  40                  45

cca gca gat att cgc gcg gct gga gga gtt gcc cgt atg gct gac cct      192
Pro Ala Asp Ile Arg Ala Ala Gly Gly Val Ala Arg Met Ala Asp Pro
    50                  55                  60

aca atc gtg gaa gaa gta atg aat gca gta tct atc ccg gta atg gca      240
Thr Ile Val Glu Glu Val Met Asn Ala Val Ser Ile Pro Val Met Ala
65                  70                  75                  80

aaa gcg cgt atc gga cat att gtt gaa gcg cgt gtg ctt gaa gct atg      288
Lys Ala Arg Ile Gly His Ile Val Glu Ala Arg Val Leu Glu Ala Met
                85                  90                  95

ggt gtt gac tat att gat gaa agt gaa gtt ctg acg ccg gct gac gaa      336
Gly Val Asp Tyr Ile Asp Glu Ser Glu Val Leu Thr Pro Ala Asp Glu
            100                 105                 110
```

```
gaa ttt cat tta aat aaa aat gaa tac aca gtt cct ttt gtc tgt ggc      384
Glu Phe His Leu Asn Lys Asn Glu Tyr Thr Val Pro Phe Val Cys Gly
        115                 120                 125

tgc cgt gat ctt ggt gaa gca aca cgc cgt att gcg gaa ggt gct tct      432
Cys Arg Asp Leu Gly Glu Ala Thr Arg Arg Ile Ala Glu Gly Ala Ser
    130                 135                 140

atg ctt cgc aca aaa ggt gag cct gga aca ggt aat att gtt gag gct      480
Met Leu Arg Thr Lys Gly Glu Pro Gly Thr Gly Asn Ile Val Glu Ala
145                 150                 155                 160

gtt cgc cat atg cgt aaa gtt aac gct caa gtg cgc aaa gta gtt gcg      528
Val Arg His Met Arg Lys Val Asn Ala Gln Val Arg Lys Val Val Ala
                165                 170                 175

atg agt gag gat gag cta atg aca gaa gcg aaa aac cta ggt gct cct      576
Met Ser Glu Asp Glu Leu Met Thr Glu Ala Lys Asn Leu Gly Ala Pro
            180                 185                 190

tac gag ctt ctt ctt caa att aaa aaa gac ggc aag ctt cct gtc gtt      624
Tyr Glu Leu Leu Leu Gln Ile Lys Lys Asp Gly Lys Leu Pro Val Val
        195                 200                 205

aac ttt gcc gct ggc ggc gta gca act cca gct gat gct gct ctc atg      672
Asn Phe Ala Ala Gly Gly Val Ala Thr Pro Ala Asp Ala Ala Leu Met
    210                 215                 220

atg cag ctt ggt gct gac gga gta ttt gtt ggt tct ggt att ttt aaa      720
Met Gln Leu Gly Ala Asp Gly Val Phe Val Gly Ser Gly Ile Phe Lys
225                 230                 235                 240

tca gac aac cct gct aaa ttt gcg aaa gca att gtg gaa gca aca act      768
Ser Asp Asn Pro Ala Lys Phe Ala Lys Ala Ile Val Glu Ala Thr Thr
                245                 250                 255

cac ttt act gat tac aaa tta atc gct gag ttg tca aaa gag ctt ggt      816
His Phe Thr Asp Tyr Lys Leu Ile Ala Glu Leu Ser Lys Glu Leu Gly
            260                 265                 270

act gca atg aaa ggg att gaa atc tca aac tta ctt cca gaa cag cgt      864
Thr Ala Met Lys Gly Ile Glu Ile Ser Asn Leu Leu Pro Glu Gln Arg
        275                 280                 285

atg caa gaa cgc ggc tgg                                              882
Met Gln Glu Arg Gly Trp
    290


<210> SEQ ID NO 16
<211> LENGTH: 294
<212> TYPE: PRT
<213> ORGANISM: Artificial sequence
<220> FEATURE:
<223> OTHER INFORMATION: basf-yaad

<400> SEQUENCE: 16

Met Ala Gln Thr Gly Thr Glu Arg Val Lys Arg Gly Met Ala Glu Met
1               5                   10                  15

Gln Lys Gly Gly Val Ile Met Asp Val Ile Asn Ala Glu Gln Ala Lys
            20                  25                  30

Ile Ala Glu Glu Ala Gly Ala Val Ala Val Met Ala Leu Glu Arg Val
        35                  40                  45

Pro Ala Asp Ile Arg Ala Ala Gly Gly Val Ala Arg Met Ala Asp Pro
    50                  55                  60

Thr Ile Val Glu Glu Val Met Asn Ala Val Ser Ile Pro Val Met Ala
65                  70                  75                  80

Lys Ala Arg Ile Gly His Ile Val Glu Ala Arg Val Leu Glu Ala Met
                85                  90                  95

Gly Val Asp Tyr Ile Asp Glu Ser Glu Val Leu Thr Pro Ala Asp Glu
            100                 105                 110

Glu Phe His Leu Asn Lys Asn Glu Tyr Thr Val Pro Phe Val Cys Gly
```

```
        115                 120                 125

Cys Arg Asp Leu Gly Glu Ala Thr Arg Arg Ile Ala Glu Gly Ala Ser
    130                 135                 140

Met Leu Arg Thr Lys Gly Glu Pro Gly Thr Gly Asn Ile Val Glu Ala
145                 150                 155                 160

Val Arg His Met Arg Lys Val Asn Ala Gln Val Arg Lys Val Val Ala
                165                 170                 175

Met Ser Glu Asp Glu Leu Met Thr Glu Ala Lys Asn Leu Gly Ala Pro
            180                 185                 190

Tyr Glu Leu Leu Leu Gln Ile Lys Lys Asp Gly Lys Leu Pro Val Val
        195                 200                 205

Asn Phe Ala Ala Gly Gly Val Ala Thr Pro Ala Asp Ala Ala Leu Met
    210                 215                 220

Met Gln Leu Gly Ala Asp Gly Val Phe Val Gly Ser Gly Ile Phe Lys
225                 230                 235                 240

Ser Asp Asn Pro Ala Lys Phe Ala Lys Ala Ile Val Glu Ala Thr Thr
                245                 250                 255

His Phe Thr Asp Tyr Lys Leu Ile Ala Glu Leu Ser Lys Glu Leu Gly
            260                 265                 270

Thr Ala Met Lys Gly Ile Glu Ile Ser Asn Leu Leu Pro Glu Gln Arg
        275                 280                 285

Met Gln Glu Arg Gly Trp
    290


<210> SEQ ID NO 17
<211> LENGTH: 591
<212> TYPE: DNA
<213> ORGANISM: Artificial sequence
<220> FEATURE:
<221> NAME/KEY: CDS
<222> LOCATION: (1)..(591)
<223> OTHER INFORMATION: basf-yaae

<400> SEQUENCE: 17

atg gga tta aca ata ggt gta cta gga ctt caa gga gca gtt aga gag       48
Met Gly Leu Thr Ile Gly Val Leu Gly Leu Gln Gly Ala Val Arg Glu
1               5                   10                  15

cac atc cat gcg att gaa gca tgc ggc gcg gct ggt ctt gtc gta aaa       96
His Ile His Ala Ile Glu Ala Cys Gly Ala Ala Gly Leu Val Val Lys
            20                  25                  30

cgt ccg gag cag ctg aac gaa gtt gac ggg ttg att ttg ccg ggc ggt      144
Arg Pro Glu Gln Leu Asn Glu Val Asp Gly Leu Ile Leu Pro Gly Gly
        35                  40                  45

gag agc acg acg atg cgc cgt ttg atc gat acg tat caa ttc atg gag      192
Glu Ser Thr Thr Met Arg Arg Leu Ile Asp Thr Tyr Gln Phe Met Glu
    50                  55                  60

ccg ctt cgt gaa ttc gct gct cag ggc aaa ccg atg ttt gga aca tgt      240
Pro Leu Arg Glu Phe Ala Ala Gln Gly Lys Pro Met Phe Gly Thr Cys
65                  70                  75                  80

gcc gga tta att ata tta gca aaa gaa att gcc ggt tca gat aat cct      288
Ala Gly Leu Ile Ile Leu Ala Lys Glu Ile Ala Gly Ser Asp Asn Pro
                85                  90                  95

cat tta ggt ctt ctg aat gtg gtt gta gaa cgt aat tca ttt ggc cgg      336
His Leu Gly Leu Leu Asn Val Val Val Glu Arg Asn Ser Phe Gly Arg
            100                 105                 110

cag gtt gac agc ttt gaa gct gat tta aca att aaa ggc ttg gac gag      384
Gln Val Asp Ser Phe Glu Ala Asp Leu Thr Ile Lys Gly Leu Asp Glu
        115                 120                 125

cct ttt act ggg gta ttc atc cgt gct ccg cat att tta gaa gct ggt      432
```

```
Pro Phe Thr Gly Val Phe Ile Arg Ala Pro His Ile Leu Glu Ala Gly
    130                 135                 140

gaa aat gtt gaa gtt cta tcg gag cat aat ggt cgt att gta gcc gcg      480
Glu Asn Val Glu Val Leu Ser Glu His Asn Gly Arg Ile Val Ala Ala
145                 150                 155                 160

aaa cag ggg caa ttc ctt ggc tgc tca ttc cat ccg gag ctg aca gaa      528
Lys Gln Gly Gln Phe Leu Gly Cys Ser Phe His Pro Glu Leu Thr Glu
                165                 170                 175

gat cac cga gtg acg cag ctg ttt gtt gaa atg gtt gag gaa tat aag      576
Asp His Arg Val Thr Gln Leu Phe Val Glu Met Val Glu Glu Tyr Lys
            180                 185                 190

caa aag gca ctt gta                                                  591
Gln Lys Ala Leu Val
        195


<210> SEQ ID NO 18
<211> LENGTH: 197
<212> TYPE: PRT
<213> ORGANISM: Artificial sequence
<220> FEATURE:
<223> OTHER INFORMATION: basf-yaae

<400> SEQUENCE: 18

Met Gly Leu Thr Ile Gly Val Leu Gly Leu Gln Gly Ala Val Arg Glu
1               5                   10                  15

His Ile His Ala Ile Glu Ala Cys Gly Ala Ala Gly Leu Val Val Lys
            20                  25                  30

Arg Pro Glu Gln Leu Asn Glu Val Asp Gly Leu Ile Leu Pro Gly Gly
        35                  40                  45

Glu Ser Thr Thr Met Arg Arg Leu Ile Asp Thr Tyr Gln Phe Met Glu
    50                  55                  60

Pro Leu Arg Glu Phe Ala Ala Gln Gly Lys Pro Met Phe Gly Thr Cys
65                  70                  75                  80

Ala Gly Leu Ile Ile Leu Ala Lys Glu Ile Ala Gly Ser Asp Asn Pro
                85                  90                  95

His Leu Gly Leu Leu Asn Val Val Val Glu Arg Asn Ser Phe Gly Arg
            100                 105                 110

Gln Val Asp Ser Phe Glu Ala Asp Leu Thr Ile Lys Gly Leu Asp Glu
        115                 120                 125

Pro Phe Thr Gly Val Phe Ile Arg Ala Pro His Ile Leu Glu Ala Gly
    130                 135                 140

Glu Asn Val Glu Val Leu Ser Glu His Asn Gly Arg Ile Val Ala Ala
145                 150                 155                 160

Lys Gln Gly Gln Phe Leu Gly Cys Ser Phe His Pro Glu Leu Thr Glu
                165                 170                 175

Asp His Arg Val Thr Gln Leu Phe Val Glu Met Val Glu Glu Tyr Lys
            180                 185                 190

Gln Lys Ala Leu Val
        195


<210> SEQ ID NO 19
<211> LENGTH: 1329
<212> TYPE: DNA
<213> ORGANISM: Artificial sequence
<220> FEATURE:
<221> NAME/KEY: CDS
<222> LOCATION: (1)..(1329)
<223> OTHER INFORMATION: basf-yaad-Xa-dewA-his

<400> SEQUENCE: 19
```

-continued

```
atg gct caa aca ggt act gaa cgt gta aaa cgc gga atg gca gaa atg       48
Met Ala Gln Thr Gly Thr Glu Arg Val Lys Arg Gly Met Ala Glu Met
1               5                   10                  15

caa aaa ggc ggc gtc atc atg gac gtc atc aat gcg gaa caa gcg aaa       96
Gln Lys Gly Gly Val Ile Met Asp Val Ile Asn Ala Glu Gln Ala Lys
            20                  25                  30

atc gct gaa gaa gct gga gct gtc gct gta atg gcg cta gaa cgt gtg      144
Ile Ala Glu Glu Ala Gly Ala Val Ala Val Met Ala Leu Glu Arg Val
        35                  40                  45

cca gca gat att cgc gcg gct gga gga gtt gcc cgt atg gct gac cct      192
Pro Ala Asp Ile Arg Ala Ala Gly Gly Val Ala Arg Met Ala Asp Pro
    50                  55                  60

aca atc gtg gaa gaa gta atg aat gca gta tct atc ccg gta atg gca      240
Thr Ile Val Glu Glu Val Met Asn Ala Val Ser Ile Pro Val Met Ala
65                  70                  75                  80

aaa gcg cgt atc gga cat att gtt gaa gcg cgt gtg ctt gaa gct atg      288
Lys Ala Arg Ile Gly His Ile Val Glu Ala Arg Val Leu Glu Ala Met
                85                  90                  95

ggt gtt gac tat att gat gaa agt gaa gtt ctg acg ccg gct gac gaa      336
Gly Val Asp Tyr Ile Asp Glu Ser Glu Val Leu Thr Pro Ala Asp Glu
            100                 105                 110

gaa ttt cat tta aat aaa aat gaa tac aca gtt cct ttt gtc tgt ggc      384
Glu Phe His Leu Asn Lys Asn Glu Tyr Thr Val Pro Phe Val Cys Gly
        115                 120                 125

tgc cgt gat ctt ggt gaa gca aca cgc cgt att gcg gaa ggt gct tct      432
Cys Arg Asp Leu Gly Glu Ala Thr Arg Arg Ile Ala Glu Gly Ala Ser
    130                 135                 140

atg ctt cgc aca aaa ggt gag cct gga aca ggt aat att gtt gag gct      480
Met Leu Arg Thr Lys Gly Glu Pro Gly Thr Gly Asn Ile Val Glu Ala
145                 150                 155                 160

gtt cgc cat atg cgt aaa gtt aac gct caa gtg cgc aaa gta gtt gcg      528
Val Arg His Met Arg Lys Val Asn Ala Gln Val Arg Lys Val Val Ala
                165                 170                 175

atg agt gag gat gag cta atg aca gaa gcg aaa aac cta ggt gct cct      576
Met Ser Glu Asp Glu Leu Met Thr Glu Ala Lys Asn Leu Gly Ala Pro
            180                 185                 190

tac gag ctt ctt ctt caa att aaa aaa gac ggc aag ctt cct gtc gtt      624
Tyr Glu Leu Leu Leu Gln Ile Lys Lys Asp Gly Lys Leu Pro Val Val
        195                 200                 205

aac ttt gcc gct ggc ggc gta gca act cca gct gat gct gct ctc atg      672
Asn Phe Ala Ala Gly Gly Val Ala Thr Pro Ala Asp Ala Ala Leu Met
    210                 215                 220

atg cag ctt ggt gct gac gga gta ttt gtt ggt tct ggt att ttt aaa      720
Met Gln Leu Gly Ala Asp Gly Val Phe Val Gly Ser Gly Ile Phe Lys
225                 230                 235                 240

tca gac aac cct gct aaa ttt gcg aaa gca att gtg gaa gca aca act      768
Ser Asp Asn Pro Ala Lys Phe Ala Lys Ala Ile Val Glu Ala Thr Thr
                245                 250                 255

cac ttt act gat tac aaa tta atc gct gag ttg tca aaa gag ctt ggt      816
His Phe Thr Asp Tyr Lys Leu Ile Ala Glu Leu Ser Lys Glu Leu Gly
            260                 265                 270

act gca atg aaa ggg att gaa atc tca aac tta ctt cca gaa cag cgt      864
Thr Ala Met Lys Gly Ile Glu Ile Ser Asn Leu Leu Pro Glu Gln Arg
        275                 280                 285

atg caa gaa cgc ggc tgg aga tcc att gaa ggc cgc atg cgc ttc atc      912
Met Gln Glu Arg Gly Trp Arg Ser Ile Glu Gly Arg Met Arg Phe Ile
    290                 295                 300

gtc tct ctc ctc gcc ttc act gcc gcg gcc acc gcg acc gcc ctc ccg      960
Val Ser Leu Leu Ala Phe Thr Ala Ala Ala Thr Ala Thr Ala Leu Pro
305                 310                 315                 320
```

```
gcc tct gcc gca aag aac gcg aag ctg gcc acc tcg gcg gcc ttc gcc     1008
Ala Ser Ala Ala Lys Asn Ala Lys Leu Ala Thr Ser Ala Ala Phe Ala
                325                 330                 335

aag cag gct gaa ggc acc acc tgc aat gtc ggc tcg atc gct tgc tgc     1056
Lys Gln Ala Glu Gly Thr Thr Cys Asn Val Gly Ser Ile Ala Cys Cys
            340                 345                 350

aac tcc ccc gct gag acc aac aac gac agt ctg ttg agc ggt ctg ctc     1104
Asn Ser Pro Ala Glu Thr Asn Asn Asp Ser Leu Leu Ser Gly Leu Leu
        355                 360                 365

ggt gct ggc ctt ctc aac ggg ctc tcg ggc aac act ggc agc gcc tgc     1152
Gly Ala Gly Leu Leu Asn Gly Leu Ser Gly Asn Thr Gly Ser Ala Cys
    370                 375                 380

gcc aag gcg agc ttg att gac cag ctg ggt ctg ctc gct ctc gtc gac     1200
Ala Lys Ala Ser Leu Ile Asp Gln Leu Gly Leu Leu Ala Leu Val Asp
385                 390                 395                 400

cac act gag gaa ggc ccc gtc tgc aag aac atc gtc gct tgc tgc cct     1248
His Thr Glu Glu Gly Pro Val Cys Lys Asn Ile Val Ala Cys Cys Pro
                405                 410                 415

gag gga acc acc aac tgt gtt gcc gtc gac aac gct ggc gct ggt acc     1296
Glu Gly Thr Thr Asn Cys Val Ala Val Asp Asn Ala Gly Ala Gly Thr
            420                 425                 430

aag gct gag gga tct cat cac cat cac cat cac                         1329
Lys Ala Glu Gly Ser His His His His His His
        435                 440


<210> SEQ ID NO 20
<211> LENGTH: 443
<212> TYPE: PRT
<213> ORGANISM: Artificial sequence
<220> FEATURE:
<223> OTHER INFORMATION: basf-yaad-Xa-dewA-his

<400> SEQUENCE: 20

Met Ala Gln Thr Gly Thr Glu Arg Val Lys Arg Gly Met Ala Glu Met
1               5                   10                  15

Gln Lys Gly Gly Val Ile Met Asp Val Ile Asn Ala Glu Gln Ala Lys
            20                  25                  30

Ile Ala Glu Glu Ala Gly Ala Val Ala Val Met Ala Leu Glu Arg Val
        35                  40                  45

Pro Ala Asp Ile Arg Ala Ala Gly Gly Val Ala Arg Met Ala Asp Pro
    50                  55                  60

Thr Ile Val Glu Glu Val Met Asn Ala Val Ser Ile Pro Val Met Ala
65                  70                  75                  80

Lys Ala Arg Ile Gly His Ile Val Glu Ala Arg Val Leu Glu Ala Met
                85                  90                  95

Gly Val Asp Tyr Ile Asp Glu Ser Glu Val Leu Thr Pro Ala Asp Glu
            100                 105                 110

Glu Phe His Leu Asn Lys Asn Glu Tyr Thr Val Pro Phe Val Cys Gly
        115                 120                 125

Cys Arg Asp Leu Gly Glu Ala Thr Arg Arg Ile Ala Glu Gly Ala Ser
    130                 135                 140

Met Leu Arg Thr Lys Gly Glu Pro Gly Thr Gly Asn Ile Val Glu Ala
145                 150                 155                 160

Val Arg His Met Arg Lys Val Asn Ala Gln Val Arg Lys Val Val Ala
                165                 170                 175

Met Ser Glu Asp Glu Leu Met Thr Glu Ala Lys Asn Leu Gly Ala Pro
            180                 185                 190

Tyr Glu Leu Leu Leu Gln Ile Lys Lys Asp Gly Lys Leu Pro Val Val
        195                 200                 205
```

```
Asn Phe Ala Ala Gly Gly Val Ala Thr Pro Ala Asp Ala Ala Leu Met
    210                 215                 220

Met Gln Leu Gly Ala Asp Gly Val Phe Val Gly Ser Gly Ile Phe Lys
225                 230                 235                 240

Ser Asp Asn Pro Ala Lys Phe Ala Lys Ala Ile Val Glu Ala Thr Thr
                245                 250                 255

His Phe Thr Asp Tyr Lys Leu Ile Ala Glu Leu Ser Lys Glu Leu Gly
            260                 265                 270

Thr Ala Met Lys Gly Ile Glu Ile Ser Asn Leu Leu Pro Glu Gln Arg
        275                 280                 285

Met Gln Glu Arg Gly Trp Arg Ser Ile Glu Gly Arg Met Arg Phe Ile
    290                 295                 300

Val Ser Leu Leu Ala Phe Thr Ala Ala Ala Thr Ala Thr Ala Leu Pro
305                 310                 315                 320

Ala Ser Ala Ala Lys Asn Ala Lys Leu Ala Thr Ser Ala Ala Phe Ala
                325                 330                 335

Lys Gln Ala Glu Gly Thr Thr Cys Asn Val Gly Ser Ile Ala Cys Cys
            340                 345                 350

Asn Ser Pro Ala Glu Thr Asn Asn Asp Ser Leu Leu Ser Gly Leu Leu
        355                 360                 365

Gly Ala Gly Leu Leu Asn Gly Leu Ser Gly Asn Thr Gly Ser Ala Cys
    370                 375                 380

Ala Lys Ala Ser Leu Ile Asp Gln Leu Gly Leu Leu Ala Leu Val Asp
385                 390                 395                 400

His Thr Glu Glu Gly Pro Val Cys Lys Asn Ile Val Ala Cys Cys Pro
                405                 410                 415

Glu Gly Thr Thr Asn Cys Val Ala Val Asp Asn Ala Gly Ala Gly Thr
            420                 425                 430

Lys Ala Glu Gly Ser His His His His His His
        435                 440


<210> SEQ ID NO 21
<211> LENGTH: 1395
<212> TYPE: DNA
<213> ORGANISM: Artificial sequence
<220> FEATURE:
<221> NAME/KEY: CDS
<222> LOCATION: (1)..(1395)
<223> OTHER INFORMATION: basf-yaad-Xa-rodA-his

<400> SEQUENCE: 21

atg gct caa aca ggt act gaa cgt gta aaa cgc gga atg gca gaa atg       48
Met Ala Gln Thr Gly Thr Glu Arg Val Lys Arg Gly Met Ala Glu Met
1               5                   10                  15

caa aaa ggc ggc gtc atc atg gac gtc atc aat gcg gaa caa gcg aaa       96
Gln Lys Gly Gly Val Ile Met Asp Val Ile Asn Ala Glu Gln Ala Lys
            20                  25                  30

atc gct gaa gaa gct gga gct gtc gct gta atg gcg cta gaa cgt gtg      144
Ile Ala Glu Glu Ala Gly Ala Val Ala Val Met Ala Leu Glu Arg Val
        35                  40                  45

cca gca gat att cgc gcg gct gga gga gtt gcc cgt atg gct gac cct      192
Pro Ala Asp Ile Arg Ala Ala Gly Gly Val Ala Arg Met Ala Asp Pro
    50                  55                  60

aca atc gtg gaa gaa gta atg aat gca gta tct atc ccg gta atg gca      240
Thr Ile Val Glu Glu Val Met Asn Ala Val Ser Ile Pro Val Met Ala
65                  70                  75                  80

aaa gcg cgt atc gga cat att gtt gaa gcg cgt gtg ctt gaa gct atg      288
Lys Ala Arg Ile Gly His Ile Val Glu Ala Arg Val Leu Glu Ala Met
```

```
                85                  90                  95

ggt gtt gac tat att gat gaa agt gaa gtt ctg acg ccg gct gac gaa      336
Gly Val Asp Tyr Ile Asp Glu Ser Glu Val Leu Thr Pro Ala Asp Glu
            100                 105                 110

gaa ttt cat tta aat aaa aat gaa tac aca gtt cct ttt gtc tgt ggc      384
Glu Phe His Leu Asn Lys Asn Glu Tyr Thr Val Pro Phe Val Cys Gly
        115                 120                 125

tgc cgt gat ctt ggt gaa gca aca cgc cgt att gcg gaa ggt gct tct      432
Cys Arg Asp Leu Gly Glu Ala Thr Arg Arg Ile Ala Glu Gly Ala Ser
    130                 135                 140

atg ctt cgc aca aaa ggt gag cct gga aca ggt aat att gtt gag gct      480
Met Leu Arg Thr Lys Gly Glu Pro Gly Thr Gly Asn Ile Val Glu Ala
145                 150                 155                 160

gtt cgc cat atg cgt aaa gtt aac gct caa gtg cgc aaa gta gtt gcg      528
Val Arg His Met Arg Lys Val Asn Ala Gln Val Arg Lys Val Val Ala
                165                 170                 175

atg agt gag gat gag cta atg aca gaa gcg aaa aac cta ggt gct cct      576
Met Ser Glu Asp Glu Leu Met Thr Glu Ala Lys Asn Leu Gly Ala Pro
            180                 185                 190

tac gag ctt ctt ctt caa att aaa aaa gac ggc aag ctt cct gtc gtt      624
Tyr Glu Leu Leu Leu Gln Ile Lys Lys Asp Gly Lys Leu Pro Val Val
        195                 200                 205

aac ttt gcc gct ggc ggc gta gca act cca gct gat gct gct ctc atg      672
Asn Phe Ala Ala Gly Gly Val Ala Thr Pro Ala Asp Ala Ala Leu Met
    210                 215                 220

atg cag ctt ggt gct gac gga gta ttt gtt ggt tct ggt att ttt aaa      720
Met Gln Leu Gly Ala Asp Gly Val Phe Val Gly Ser Gly Ile Phe Lys
225                 230                 235                 240

tca gac aac cct gct aaa ttt gcg aaa gca att gtg gaa gca aca act      768
Ser Asp Asn Pro Ala Lys Phe Ala Lys Ala Ile Val Glu Ala Thr Thr
                245                 250                 255

cac ttt act gat tac aaa tta atc gct gag ttg tca aaa gag ctt ggt      816
His Phe Thr Asp Tyr Lys Leu Ile Ala Glu Leu Ser Lys Glu Leu Gly
            260                 265                 270

act gca atg aaa ggg att gaa atc tca aac tta ctt cca gaa cag cgt      864
Thr Ala Met Lys Gly Ile Glu Ile Ser Asn Leu Leu Pro Glu Gln Arg
        275                 280                 285

atg caa gaa cgc ggc tgg aga tct att gaa ggc cgc atg aag ttc tcc      912
Met Gln Glu Arg Gly Trp Arg Ser Ile Glu Gly Arg Met Lys Phe Ser
    290                 295                 300

att gct gcc gct gtc gtt gct ttc gcc gcc tcc gtc gcg gcc ctc cct      960
Ile Ala Ala Ala Val Val Ala Phe Ala Ala Ser Val Ala Ala Leu Pro
305                 310                 315                 320

cct gcc cat gat tcc cag ttc gct ggc aat ggt gtt ggc aac aag ggc     1008
Pro Ala His Asp Ser Gln Phe Ala Gly Asn Gly Val Gly Asn Lys Gly
                325                 330                 335

aac agc aac gtc aag ttc cct gtc ccc gaa aac gtg acc gtc aag cag     1056
Asn Ser Asn Val Lys Phe Pro Val Pro Glu Asn Val Thr Val Lys Gln
            340                 345                 350

gcc tcc gac aag tgc ggt gac cag gcc cag ctc tct tgc tgc aac aag     1104
Ala Ser Asp Lys Cys Gly Asp Gln Ala Gln Leu Ser Cys Cys Asn Lys
        355                 360                 365

gcc acg tac gcc ggt gac acc aca acc gtt gat gag ggt ctt ctg tct     1152
Ala Thr Tyr Ala Gly Asp Thr Thr Thr Val Asp Glu Gly Leu Leu Ser
    370                 375                 380

ggt gcc ctc agc ggc ctc atc ggc gcc ggg tct ggt gcc gaa ggt ctt     1200
Gly Ala Leu Ser Gly Leu Ile Gly Ala Gly Ser Gly Ala Glu Gly Leu
385                 390                 395                 400

ggt ctc ttc gat cag tgc tcc aag ctt gat gtt gct gtc ctc att ggc     1248
Gly Leu Phe Asp Gln Cys Ser Lys Leu Asp Val Ala Val Leu Ile Gly
```

```
                405                 410                 415

atc caa gat ctt gtc aac cag aag tgc aag caa aac att gcc tgc tgc     1296
Ile Gln Asp Leu Val Asn Gln Lys Cys Lys Gln Asn Ile Ala Cys Cys
            420                 425                 430

cag aac tcc ccc tcc agc gcg gat ggc aac ctt att ggt gtc ggt ctc     1344
Gln Asn Ser Pro Ser Ser Ala Asp Gly Asn Leu Ile Gly Val Gly Leu
        435                 440                 445

cct tgc gtt gcc ctt ggc tcc atc ctc gga tct cat cac cat cac cat     1392
Pro Cys Val Ala Leu Gly Ser Ile Leu Gly Ser His His His His His
    450                 455                 460

cac                                                                 1395
His
465


<210> SEQ ID NO 22
<211> LENGTH: 465
<212> TYPE: PRT
<213> ORGANISM: Artificial sequence
<220> FEATURE:
<223> OTHER INFORMATION: basf-yaad-Xa-rodA-his

<400> SEQUENCE: 22

Met Ala Gln Thr Gly Thr Glu Arg Val Lys Arg Gly Met Ala Glu Met
1               5                   10                  15

Gln Lys Gly Gly Val Ile Met Asp Val Ile Asn Ala Glu Gln Ala Lys
            20                  25                  30

Ile Ala Glu Glu Ala Gly Ala Val Ala Val Met Ala Leu Glu Arg Val
        35                  40                  45

Pro Ala Asp Ile Arg Ala Ala Gly Gly Val Ala Arg Met Ala Asp Pro
    50                  55                  60

Thr Ile Val Glu Glu Val Met Asn Ala Val Ser Ile Pro Val Met Ala
65                  70                  75                  80

Lys Ala Arg Ile Gly His Ile Val Glu Ala Arg Val Leu Glu Ala Met
                85                  90                  95

Gly Val Asp Tyr Ile Asp Glu Ser Glu Val Leu Thr Pro Ala Asp Glu
            100                 105                 110

Glu Phe His Leu Asn Lys Asn Glu Tyr Thr Val Pro Phe Val Cys Gly
        115                 120                 125

Cys Arg Asp Leu Gly Glu Ala Thr Arg Arg Ile Ala Glu Gly Ala Ser
    130                 135                 140

Met Leu Arg Thr Lys Gly Glu Pro Gly Thr Gly Asn Ile Val Glu Ala
145                 150                 155                 160

Val Arg His Met Arg Lys Val Asn Ala Gln Val Arg Lys Val Val Ala
                165                 170                 175

Met Ser Glu Asp Glu Leu Met Thr Glu Ala Lys Asn Leu Gly Ala Pro
            180                 185                 190

Tyr Glu Leu Leu Leu Gln Ile Lys Lys Asp Gly Lys Leu Pro Val Val
        195                 200                 205

Asn Phe Ala Ala Gly Gly Val Ala Thr Pro Ala Asp Ala Ala Leu Met
    210                 215                 220

Met Gln Leu Gly Ala Asp Gly Val Phe Val Gly Ser Gly Ile Phe Lys
225                 230                 235                 240

Ser Asp Asn Pro Ala Lys Phe Ala Lys Ala Ile Val Glu Ala Thr Thr
                245                 250                 255

His Phe Thr Asp Tyr Lys Leu Ile Ala Glu Leu Ser Lys Glu Leu Gly
            260                 265                 270

Thr Ala Met Lys Gly Ile Glu Ile Ser Asn Leu Leu Pro Glu Gln Arg
```

```
        275                 280                 285

Met Gln Glu Arg Gly Trp Arg Ser Ile Glu Gly Arg Met Lys Phe Ser
    290                 295                 300

Ile Ala Ala Ala Val Val Ala Phe Ala Ala Ser Val Ala Ala Leu Pro
305                 310                 315                 320

Pro Ala His Asp Ser Gln Phe Ala Gly Asn Gly Val Gly Asn Lys Gly
                325                 330                 335

Asn Ser Asn Val Lys Phe Pro Val Pro Glu Asn Val Thr Val Lys Gln
            340                 345                 350

Ala Ser Asp Lys Cys Gly Asp Gln Ala Gln Leu Ser Cys Cys Asn Lys
        355                 360                 365

Ala Thr Tyr Ala Gly Asp Thr Thr Thr Val Asp Glu Gly Leu Leu Ser
    370                 375                 380

Gly Ala Leu Ser Gly Leu Ile Gly Ala Gly Ser Gly Ala Glu Gly Leu
385                 390                 395                 400

Gly Leu Phe Asp Gln Cys Ser Lys Leu Asp Val Ala Val Leu Ile Gly
                405                 410                 415

Ile Gln Asp Leu Val Asn Gln Lys Cys Lys Gln Asn Ile Ala Cys Cys
            420                 425                 430

Gln Asn Ser Pro Ser Ser Ala Asp Gly Asn Leu Ile Gly Val Gly Leu
        435                 440                 445

Pro Cys Val Ala Leu Gly Ser Ile Leu Gly Ser His His His His His
    450                 455                 460

His
465


<210> SEQ ID NO 23
<211> LENGTH: 1407
<212> TYPE: DNA
<213> ORGANISM: Artificial sequence
<220> FEATURE:
<221> NAME/KEY: CDS
<222> LOCATION: (1)..(1407)
<223> OTHER INFORMATION: basf-yaad-Xa-BASF1-his

<400> SEQUENCE: 23

atg gct caa aca ggt act gaa cgt gta aaa cgc gga atg gca gaa atg       48
Met Ala Gln Thr Gly Thr Glu Arg Val Lys Arg Gly Met Ala Glu Met
1               5                   10                  15

caa aaa ggc ggc gtc atc atg gac gtc atc aat gcg gaa caa gcg aaa       96
Gln Lys Gly Gly Val Ile Met Asp Val Ile Asn Ala Glu Gln Ala Lys
            20                  25                  30

atc gct gaa gaa gct gga gct gtc gct gta atg gcg cta gaa cgt gtg      144
Ile Ala Glu Glu Ala Gly Ala Val Ala Val Met Ala Leu Glu Arg Val
        35                  40                  45

cca gca gat att cgc gcg gct gga gga gtt gcc cgt atg gct gac cct      192
Pro Ala Asp Ile Arg Ala Ala Gly Gly Val Ala Arg Met Ala Asp Pro
    50                  55                  60

aca atc gtg gaa gaa gta atg aat gca gta tct atc ccg gta atg gca      240
Thr Ile Val Glu Glu Val Met Asn Ala Val Ser Ile Pro Val Met Ala
65                  70                  75                  80

aaa gcg cgt atc gga cat att gtt gaa gcg cgt gtg ctt gaa gct atg      288
Lys Ala Arg Ile Gly His Ile Val Glu Ala Arg Val Leu Glu Ala Met
                85                  90                  95

ggt gtt gac tat att gat gaa agt gaa gtt ctg acg ccg gct gac gaa      336
Gly Val Asp Tyr Ile Asp Glu Ser Glu Val Leu Thr Pro Ala Asp Glu
            100                 105                 110

gaa ttt cat tta aat aaa aat gaa tac aca gtt cct ttt gtc tgt ggc      384
Glu Phe His Leu Asn Lys Asn Glu Tyr Thr Val Pro Phe Val Cys Gly
```

```
        115                 120                 125

tgc cgt gat ctt ggt gaa gca aca cgc cgt att gcg gaa ggt gct tct      432
Cys Arg Asp Leu Gly Glu Ala Thr Arg Arg Ile Ala Glu Gly Ala Ser
    130                 135                 140

atg ctt cgc aca aaa ggt gag cct gga aca ggt aat att gtt gag gct      480
Met Leu Arg Thr Lys Gly Glu Pro Gly Thr Gly Asn Ile Val Glu Ala
145                 150                 155                 160

gtt cgc cat atg cgt aaa gtt aac gct caa gtg cgc aaa gta gtt gcg      528
Val Arg His Met Arg Lys Val Asn Ala Gln Val Arg Lys Val Val Ala
                165                 170                 175

atg agt gag gat gag cta atg aca gaa gcg aaa aac cta ggt gct cct      576
Met Ser Glu Asp Glu Leu Met Thr Glu Ala Lys Asn Leu Gly Ala Pro
            180                 185                 190

tac gag ctt ctt ctt caa att aaa aaa gac ggc aag ctt cct gtc gtt      624
Tyr Glu Leu Leu Leu Gln Ile Lys Lys Asp Gly Lys Leu Pro Val Val
        195                 200                 205

aac ttt gcc gct ggc ggc gta gca act cca gct gat gct gct ctc atg      672
Asn Phe Ala Ala Gly Gly Val Ala Thr Pro Ala Asp Ala Ala Leu Met
    210                 215                 220

atg cag ctt ggt gct gac gga gta ttt gtt ggt tct ggt att ttt aaa      720
Met Gln Leu Gly Ala Asp Gly Val Phe Val Gly Ser Gly Ile Phe Lys
225                 230                 235                 240

tca gac aac cct gct aaa ttt gcg aaa gca att gtg gaa gca aca act      768
Ser Asp Asn Pro Ala Lys Phe Ala Lys Ala Ile Val Glu Ala Thr Thr
                245                 250                 255

cac ttt act gat tac aaa tta atc gct gag ttg tca aaa gag ctt ggt      816
His Phe Thr Asp Tyr Lys Leu Ile Ala Glu Leu Ser Lys Glu Leu Gly
            260                 265                 270

act gca atg aaa ggg att gaa atc tca aac tta ctt cca gaa cag cgt      864
Thr Ala Met Lys Gly Ile Glu Ile Ser Asn Leu Leu Pro Glu Gln Arg
        275                 280                 285

atg caa gaa cgc ggc tgg aga tct att gaa ggc cgc atg aag ttc tcc      912
Met Gln Glu Arg Gly Trp Arg Ser Ile Glu Gly Arg Met Lys Phe Ser
    290                 295                 300

gtc tcc gcc gcc gtc ctc gcc ttc gcc gcc tcc gtc gcc gcc ctc cct      960
Val Ser Ala Ala Val Leu Ala Phe Ala Ala Ser Val Ala Ala Leu Pro
305                 310                 315                 320

cag cac gac tcc gcc gcc ggc aac ggc aac ggc gtc ggc aac aag ttc     1008
Gln His Asp Ser Ala Ala Gly Asn Gly Asn Gly Val Gly Asn Lys Phe
                325                 330                 335

cct gtc cct gac gac gtc acc gtc aag cag gcc acc gac aag tgc ggc     1056
Pro Val Pro Asp Asp Val Thr Val Lys Gln Ala Thr Asp Lys Cys Gly
            340                 345                 350

gac cag gcc cag ctc tcc tgc tgc aac aag gcc acc tac gcc ggc gac     1104
Asp Gln Ala Gln Leu Ser Cys Cys Asn Lys Ala Thr Tyr Ala Gly Asp
        355                 360                 365

gtc ctc acc gac atc gac gag ggc atc ctc gcc ggc ctc ctc aag aac     1152
Val Leu Thr Asp Ile Asp Glu Gly Ile Leu Ala Gly Leu Leu Lys Asn
    370                 375                 380

ctc atc ggc ggc ggc tcc ggc tcc gag ggc ctc ggc ctc ttc gac cag     1200
Leu Ile Gly Gly Gly Ser Gly Ser Glu Gly Leu Gly Leu Phe Asp Gln
385                 390                 395                 400

tgc gtc aag ctc gac ctc cag atc tcc gtc atc ggc atc cct atc cag     1248
Cys Val Lys Leu Asp Leu Gln Ile Ser Val Ile Gly Ile Pro Ile Gln
                405                 410                 415

gac ctc ctc aac cag gtc aac aag cag tgc aag cag aac atc gcc tgc     1296
Asp Leu Leu Asn Gln Val Asn Lys Gln Cys Lys Gln Asn Ile Ala Cys
            420                 425                 430

tgc cag aac tcc cct tcc gac gcc acc ggc tcc ctc gtc aac ctc ggc     1344
Cys Gln Asn Ser Pro Ser Asp Ala Thr Gly Ser Leu Val Asn Leu Gly
```

```
        435                 440                 445

ctc ggc aac cct tgc atc cct gtc tcc ctc ctc cat atg gga tct cat     1392
Leu Gly Asn Pro Cys Ile Pro Val Ser Leu Leu His Met Gly Ser His
    450                 455                 460

cac cat cac cat cac                                                 1407
His His His His His
465


<210> SEQ ID NO 24
<211> LENGTH: 469
<212> TYPE: PRT
<213> ORGANISM: Artificial sequence
<220> FEATURE:
<223> OTHER INFORMATION: basf-yaad-Xa-BASF1-his

<400> SEQUENCE: 24

Met Ala Gln Thr Gly Thr Glu Arg Val Lys Arg Gly Met Ala Glu Met
1               5                   10                  15

Gln Lys Gly Gly Val Ile Met Asp Val Ile Asn Ala Glu Gln Ala Lys
            20                  25                  30

Ile Ala Glu Glu Ala Gly Ala Val Ala Val Met Ala Leu Glu Arg Val
        35                  40                  45

Pro Ala Asp Ile Arg Ala Ala Gly Gly Val Ala Arg Met Ala Asp Pro
    50                  55                  60

Thr Ile Val Glu Glu Val Met Asn Ala Val Ser Ile Pro Val Met Ala
65                  70                  75                  80

Lys Ala Arg Ile Gly His Ile Val Glu Ala Arg Val Leu Glu Ala Met
                85                  90                  95

Gly Val Asp Tyr Ile Asp Glu Ser Glu Val Leu Thr Pro Ala Asp Glu
            100                 105                 110

Glu Phe His Leu Asn Lys Asn Glu Tyr Thr Val Pro Phe Val Cys Gly
        115                 120                 125

Cys Arg Asp Leu Gly Glu Ala Thr Arg Arg Ile Ala Glu Gly Ala Ser
    130                 135                 140

Met Leu Arg Thr Lys Gly Glu Pro Gly Thr Gly Asn Ile Val Glu Ala
145                 150                 155                 160

Val Arg His Met Arg Lys Val Asn Ala Gln Val Arg Lys Val Val Ala
                165                 170                 175

Met Ser Glu Asp Glu Leu Met Thr Glu Ala Lys Asn Leu Gly Ala Pro
            180                 185                 190

Tyr Glu Leu Leu Leu Gln Ile Lys Lys Asp Gly Lys Leu Pro Val Val
        195                 200                 205

Asn Phe Ala Ala Gly Gly Val Ala Thr Pro Ala Asp Ala Ala Leu Met
    210                 215                 220

Met Gln Leu Gly Ala Asp Gly Val Phe Val Gly Ser Gly Ile Phe Lys
225                 230                 235                 240

Ser Asp Asn Pro Ala Lys Phe Ala Lys Ala Ile Val Glu Ala Thr Thr
                245                 250                 255

His Phe Thr Asp Tyr Lys Leu Ile Ala Glu Leu Ser Lys Glu Leu Gly
            260                 265                 270

Thr Ala Met Lys Gly Ile Glu Ile Ser Asn Leu Leu Pro Glu Gln Arg
        275                 280                 285

Met Gln Glu Arg Gly Trp Arg Ser Ile Glu Gly Arg Met Lys Phe Ser
    290                 295                 300

Val Ser Ala Ala Val Leu Ala Phe Ala Ala Ser Val Ala Ala Leu Pro
305                 310                 315                 320
```

```
Gln His Asp Ser Ala Ala Gly Asn Gly Asn Gly Val Gly Asn Lys Phe
                325                 330                 335

Pro Val Pro Asp Asp Val Thr Val Lys Gln Ala Thr Asp Lys Cys Gly
            340                 345                 350

Asp Gln Ala Gln Leu Ser Cys Cys Asn Lys Ala Thr Tyr Ala Gly Asp
        355                 360                 365

Val Leu Thr Asp Ile Asp Glu Gly Ile Leu Ala Gly Leu Leu Lys Asn
    370                 375                 380

Leu Ile Gly Gly Gly Ser Gly Ser Glu Gly Leu Gly Leu Phe Asp Gln
385                 390                 395                 400

Cys Val Lys Leu Asp Leu Gln Ile Ser Val Ile Gly Ile Pro Ile Gln
                405                 410                 415

Asp Leu Leu Asn Gln Val Asn Lys Gln Cys Lys Gln Asn Ile Ala Cys
            420                 425                 430

Cys Gln Asn Ser Pro Ser Asp Ala Thr Gly Ser Leu Val Asn Leu Gly
        435                 440                 445

Leu Gly Asn Pro Cys Ile Pro Val Ser Leu Leu His Met Gly Ser His
    450                 455                 460

His His His His His
465


<210> SEQ ID NO 25
<211> LENGTH: 28
<212> TYPE: DNA
<213> ORGANISM: Unknown
<220> FEATURE:
<223> OTHER INFORMATION: Hal570 oligonucleotide

<400> SEQUENCE: 25

gcgcgcccat ggctcaaaca ggtactga                                        28


<210> SEQ ID NO 26
<211> LENGTH: 28
<212> TYPE: DNA
<213> ORGANISM: Unknown
<220> FEATURE:
<223> OTHER INFORMATION: Hal571 oligonucleotide

<400> SEQUENCE: 26

gcagatctcc agccgcgttc ttgcatac                                        28


<210> SEQ ID NO 27
<211> LENGTH: 30
<212> TYPE: DNA
<213> ORGANISM: Unknown
<220> FEATURE:
<223> OTHER INFORMATION: Hal572 oligonucleotide

<400> SEQUENCE: 27

ggccatggga ttaacaatag gtgtactagg                                      30


<210> SEQ ID NO 28
<211> LENGTH: 33
<212> TYPE: DNA
<213> ORGANISM: Unknown
<220> FEATURE:
<223> OTHER INFORMATION: Hal573 oligonucleotide

<400> SEQUENCE: 28

gcagatctta caagtgcctt ttgcttatat tcc                                  33


<210> SEQ ID NO 29
```

<211> LENGTH: 38
<212> TYPE: DNA
<213> ORGANISM: Unknown
<220> FEATURE:
<223> OTHER INFORMATION: KaM416 oligonucleotide

<400> SEQUENCE: 29 gcagcccatc agggatccct cagccttggt accagcgc 38

<210> SEQ ID NO 30
<211> LENGTH: 50
<212> TYPE: DNA
<213> ORGANISM: Unknown
<220> FEATURE:
<223> OTHER INFORMATION: KaM417 oligonucleotide

<400> SEQUENCE: 30 cccgtagcta gtggatccat tgaaggccgc atgaagttct ccgtctccgc 50

<210> SEQ ID NO 31
<211> LENGTH: 45
<212> TYPE: DNA
<213> ORGANISM: Unknown
<220> FEATURE:
<223> OTHER INFORMATION: KaM434 oligonucleotide

<400> SEQUENCE: 31 gctaagcgga tccattgaag gccgcatgaa gttctccatt gctgc 45

<210> SEQ ID NO 32
<211> LENGTH: 30
<212> TYPE: DNA
<213> ORGANISM: Unknown
<220> FEATURE:
<223> OTHER INFORMATION: KaM435 oligonucleotide

<400> SEQUENCE: 32 ccaatgggga tccgaggatg gagccaaggg 30

<210> SEQ ID NO 33
<211> LENGTH: 38
<212> TYPE: DNA
<213> ORGANISM: Unknown
<220> FEATURE:
<223> OTHER INFORMATION: KaM418 oligonucleotide

<400> SEQUENCE: 33 ctgccattca ggggatccca tatggaggag ggagacag 38

<210> SEQ ID NO 34
<211> LENGTH: 32
<212> TYPE: DNA
<213> ORGANISM: Unknown
<220> FEATURE:
<223> OTHER INFORMATION: KaM464 oligonucleotide

<400> SEQUENCE: 34 cgttaaggat ccgaggatgt tgatgggggt gc 32

<210> SEQ ID NO 35
<211> LENGTH: 35
<212> TYPE: DNA
<213> ORGANISM: Unknown

-continued

```
<220> FEATURE:
<223> OTHER INFORMATION: KaM465 oligonucleotide

<400> SEQUENCE: 35

gctaacagat ctatgttcgc ccgtctcccc gtcgt                                35
```

What is claimed is:

1. A process for defoaming liquid fuel comprising adding at least one hydrophobin or derivative thereof to the fuel.

2. The process of claim 1, wherein the fuel is a diesel fuel.

3. The process of claim 1, wherein the at least one hydrophobin or derivative thereof comprises 0.1 to 100 ppm of the fuel.

4. The process of claim 1, wherein the at least one hydrophobin or derivative thereof comprises 0.15 to 50 ppm of the fuel.

5. The process of claim 1, wherein the at least one hydrophobin or derivative thereof comprises from 0.2 to 30 ppm of the fuel.

6. The process of claim 1, wherein the at least one hydrophobin or derivative thereof comprises from 0.3 to 10 ppm of the fuel.

7. A fuel additive composition comprising at least one hydrophobin or a derivative thereof and at least one fuel additive selected from the group consisting of detergents, demulsifiers, additives that improve the cold properties of the fuel composition, carrier oils, corrosion inhibitors, dehazers, antifoams, cetane number improvers, combustion improvers, stabilizers, antistats, metallocenes, methylcyclopentadienylmanganese tricarbonyl, lubricity improvers and amines.

8. The additive composition of claim 7, wherein the at least one fuel additive comprises a demulsifier.

9. The additive composition of claim 7, wherein the at least one fuel additive comprises a detergent.

10. The additive composition of claim 9, wherein the at least one fuel additive further comprises a demulsifier.

11. A fuel composition comprising a fuel as a main constituent, at least one hydrophobin or derivative thereof, and at least one further fuel additive.

12. The fuel composition of claim 11, wherein the fuel is diesel fuel.

13. The fuel composition of claim 11, wherein the at least one further fuel additive is selected from the group consisting of detergents, demulsifiers, additives that improve the cold properties of the fuel composition, corrosion inhibitors, dehazers, antifoams, cetane number improvers, combustion improvers, antioxidants, stabilizers, antistats, metallocenes, methylcyclopentadienylmanganese tricarbonyl, lubricity improvers, dyes, and amines.

14. A process for producing a fuel composition comprising mixing a fuel or a fuel composition with a hydrophobin or derivative thereof and at least one fuel additive.

15. The process of claim 14, wherein the at least one fuel additive is selected from the group consisting of a detergent and a demulsifier.

16. The fuel additive composition of claim 7, further comprising a fuel additive selected from the group consisting of antioxidants.

* * * * *